US006424242B1

(12) United States Patent
Shinoura et al.

(10) Patent No.: US 6,424,242 B1
(45) **Date of Patent: *Jul. 23, 2002**

(54) SWITCH FOR HIGH FREQUENCY

(75) Inventors: Tatsuo Shinoura; Kiyoaki Kuzukawa; Masanori Nakamura, all of Kyoto (JP)

(73) Assignee: Omron Corporation, Kyoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/230,916

(22) PCT Filed: Aug. 7, 1997

(86) PCT No.: PCT/JP97/02747

§ 371 (c)(1),
(2), (4) Date: Feb. 3, 1999

(87) PCT Pub. No.: WO98/07169

PCT Pub. Date: Feb. 19, 1998

(30) Foreign Application Priority Data

Aug. 9, 1996 (JP) ..... 8-210924
Aug. 23, 1996 (JP) ..... 8-222186

(51) Int. Cl.[7] ..... H01H 51/22
(52) U.S. Cl. ..... 335/78; 335/80; 335/83
(58) Field of Search ..... 335/78–86, 124, 335/128

(56) References Cited

U.S. PATENT DOCUMENTS 4,740,771 A * 4/1988 Motoyama et al. ..... 335/274
5,025,237 A * 6/1991 Yamazki et al. ..... 335/83
5,025,238 A * 6/1991 Matuo et al. ..... 335/128
5,644,115 A * 7/1997 Knauer ..... 335/151

FOREIGN PATENT DOCUMENTS

| | | |
|---|---|---|
| EP | 0 249 758 A | 12/1987 |
| EP | 0 334 393 A | 9/1989 |
| EP | 0 336 445 A | 10/1989 |
| EP | 0 361 442 A | 4/1990 |
| JP | 3-167725 | 7/1991 |
| JP | 5-205597 | 8/1993 |
| JP | 6-38354 | 10/1994 |
| JP | 6-333481 | 12/1994 |
| JP | 7-65684 | 3/1995 |

OTHER PUBLICATIONS

European Search Report for EP Application No. 97934718.4–2302–JP9702747

* cited by examiner

*Primary Examiner*—Lincoln Donovan
(74) *Attorney, Agent, or Firm*—Morrison & Foerster LLP

(57) ABSTRACT

Insulating walls 14 and 15 are arranged between fixed contacts 21*a* and 23*a* that face a movable contactor 51*b* while being able to come in and out of contact with it and a shield plate 24 positioned on the back surface side of the fixed contacts 21*a* and 23*a*. With this arrangement, a compact high-frequency use switch having the desired high-frequency characteristic can be obtained with high productivity.

11 Claims, 35 Drawing Sheets

SWITCH FOR HIGH FREQUENCY

TECHNICAL FIELD

The present invention relates to high-frequency use switches, and in particular, to a high-frequency use switch intended principally for switching a high-frequency current circuit.

BACKGROUND ART

Conventionally, there has been a high-frequency use switch as disclosed, for example, in Japanese Utility Model Publication No. HEI 6-38354, for the purpose of improving the high-frequency characteristic of the high-frequency use switch.

This is a high-frequency use switch such that a box-shaped shield casing is mounted on a substrate that is insert-molded in line with a fixed contact member and a movable contact member is brought in and out of contact with an upper end portion of the fixed contact member that is projecting from a bottom surface of this shield casing, thereby opening and closing the high-frequency current circuit.

However, the aforementioned high-frequency use switch is hard to obtain the desired high-frequency characteristic and also necessitates the box-shaped shield casing having a complicated shape. These factors lead to the problems of low productivity and difficulties in dimensional reduction.

In view of the aforementioned problems, the present invention has the object of providing a compact high-frequency use switch of a high productivity.

DISCLOSURE OF THE INVENTION

In order to achieve the aforementioned object, a first inventive feature of the present application is a high-frequency use switch, wherein a dielectric is arranged between a fixed contact that faces a movable contact while being able to come in and out of contact with it and a shield member located in the vicinity of the fixed contact.

A second inventive feature of the present application is a high-frequency use switch, wherein a plurality of movable contactors that reciprocate in the direction of thickness thereof on the basis of excitation and nonexcitation of an electromagnet block are brought in and out of contact alternately with a common fixed contact and a normally-open fixed contact and with the common fixed contact and a normally-closed fixed contact so as to open and close a high-frequency current circuit, and wherein a dielectric is arranged between the fixed contact and a shield member positioned in the vicinity of the fixed contact.

According to the first or second inventive feature of the present application, the desired frequency characteristic can be secured without using a box-shaped shield casing having a complicated shape as in the prior art. For this reason, a compact high-frequency use switch can be obtained with high productivity.

A third inventive feature is a high-frequency use switch characterized in that the dielectric is an insulating wall integrally formed with a base.

According to the third feature, the dielectric is the insulating wall integrated with the base, and there is a reduction in the number of components and assembling processes. For this reason, a compact high-frequency use switch can be obtained with higher productivity.

A fourth feature is that the dielectric is constructed of a plurality of insulating walls arranged parallel to each other with a distance between opposite faces equal to the thickness of the shield member.

According to the fourth feature, the dielectric serves as a member for positioning the shield member, and therefore, the assembling performance is improved.

A fifth feature is that a lower end portion of a fixed contact terminal provided with the fixed contact and a lower end portion of a ground terminal extended from the shield member are arranged in line with each other.

According to the fifth feature, the terminal portion of the fixed contact terminal and the ground terminal of the shield member are arranged in line with each other. For this reason, the mounting work on a printed board or the like is facilitated to a convenience.

A sixth feature is that a ground tongue with which the movable contactor comes in contact when separated from the fixed contact extends on the shield member.

According to the sixth feature, the movable contactor comes into contact with the ground tongue of the shield member when separated from the fixed contact, and therefore, the high-frequency characteristic when the contact is opened is further improved.

A seventh feature is that an engagement pawl with which a restoration spring for urging the movable contactor is engaged extends on the shield member.

According to the seventh feature, the restoration spring for urging the movable contactor is engaged with the engagement pawl of the shield member, and therefore, the assembly of the switch is facilitated.

An eighth feature is that a pair of common fixed contacts whose contact surfaces to be brought in contact with the movable contactor are directed in opposite directions are provided in upper portions of the common fixed contact terminal.

According to the eighth feature, the different movable contactors alternately come into contact with the pair of fixed contacts provided at the upper portions of the common fixed contact terminal. This arrangement allows the obtainment of a high-frequency use switch capable of opening and closing different high-frequency current circuits with interposition of the dielectric.

A ninth feature is that a pair of movable contactors that are arranged in parallel so as not to face each other are made to simultaneously reciprocate in the direction of plate thickness so as to come in contact alternately with the fixed contact, thereby opening and closing different high-frequency current circuits.

According to the ninth feature, the pair of movable contactors that are arranged in parallel so as not to face each other come in and out of contact alternately with the different fixed contacts. This arrangement allows the obtainment of a high-frequency use switch of which the adjacent movable contactors are magnetically influenced less, assuring a superior high-frequency characteristic.

A tenth feature is that a pair of movable contactors that are arranged in line with one another in an insulated state are made to simultaneously reciprocate in the direction of plate thickness so as to come in contact alternately with the fixed contact, thereby opening and closing different high-frequency current circuits.

According to the tenth feature, the pair of movable contactors arranged in line with each other in the insulated state alternately come in and out of contact with the fixed contact, thereby opening and closing the different high-frequency current circuits. This arrangement allows the obtainment of a high-frequency use switch that facilitates the manufacturing of a movable block having the movable contactor, assuring higher productivity.

An eleventh feature is a high-frequency use switch, wherein a dielectric is arranged between a fixed contact that faces a movable contact while being able to come in and out of contact with it and a shield member positioned roughly in a plane identical to that of the fixed contact.

A twelfth feature is a plurality of movable contactors that reciprocate in the direction of thickness thereof on the basis of excitation and nonexcitation of an electromagnet block are brought in and out of contact alternately with a common fixed contact and a normally-open fixed contact and with the common fixed contact and a normally-closed fixed contact so as to open and close a high-frequency current circuit, and wherein a dielectric is arranged between the fixed contact and the shield member positioned in a plane roughly identical to that of the fixed contact.

According to the eleventh and twelfth features, the desired frequency characteristic can be secured without using a box-shaped shield casing having the complicated shape as in the prior art. For this reason, a compact high-frequency use switch can be obtained with high productivity.

Particularly by arranging the shield member and the fixed contact in the roughly identical planar form, the so-called coplanar guide structure can be constructed. For this reason, a high-frequency use switch having the desired frequency characteristic can be obtained.

Furthermore, the ground terminal of the shield member and the fixed contact are arranged in line with each other, so that the mounting work on the printed board or the like is facilitated.

A thirteenth feature is that the shield member and the fixed contact are integrated with each other by a dielectric.

According to the thirteenth feature, the shield member and the fixed contact are integrated with each other by the dielectric, and therefore, the number of components and the number of assembling processes in the assembling line are reduced to allow the productivity to be improved.

A fourteenth feature is that a ground tongue with which the movable contactor that is separated from the fixed contact comes in contact extends at least in one end portion of the shield member.

According to the fourteenth feature, the movable contactor comes into contact with the ground tongue of the shield member when separated from the fixed contact, and therefore, the high-frequency characteristic when the contact is opened is further improved.

A fifteenth feature is that a bending use shoulder portion is integrally formed with a base portion of the ground tongue.

According to the fifteenth feature, the bending use shoulder portion integrally formed with the base portion of the ground tongue can be used as a reference plane. For this reason, the ground tongue bending work becomes accurate, thereby allowing the assembling accuracy to be improved. Furthermore, the bending work can be performed rapidly, producing the effect of further improving the productivity.

BEST MODE FOR CARRYING OUT THE INVENTION

Figure 1:
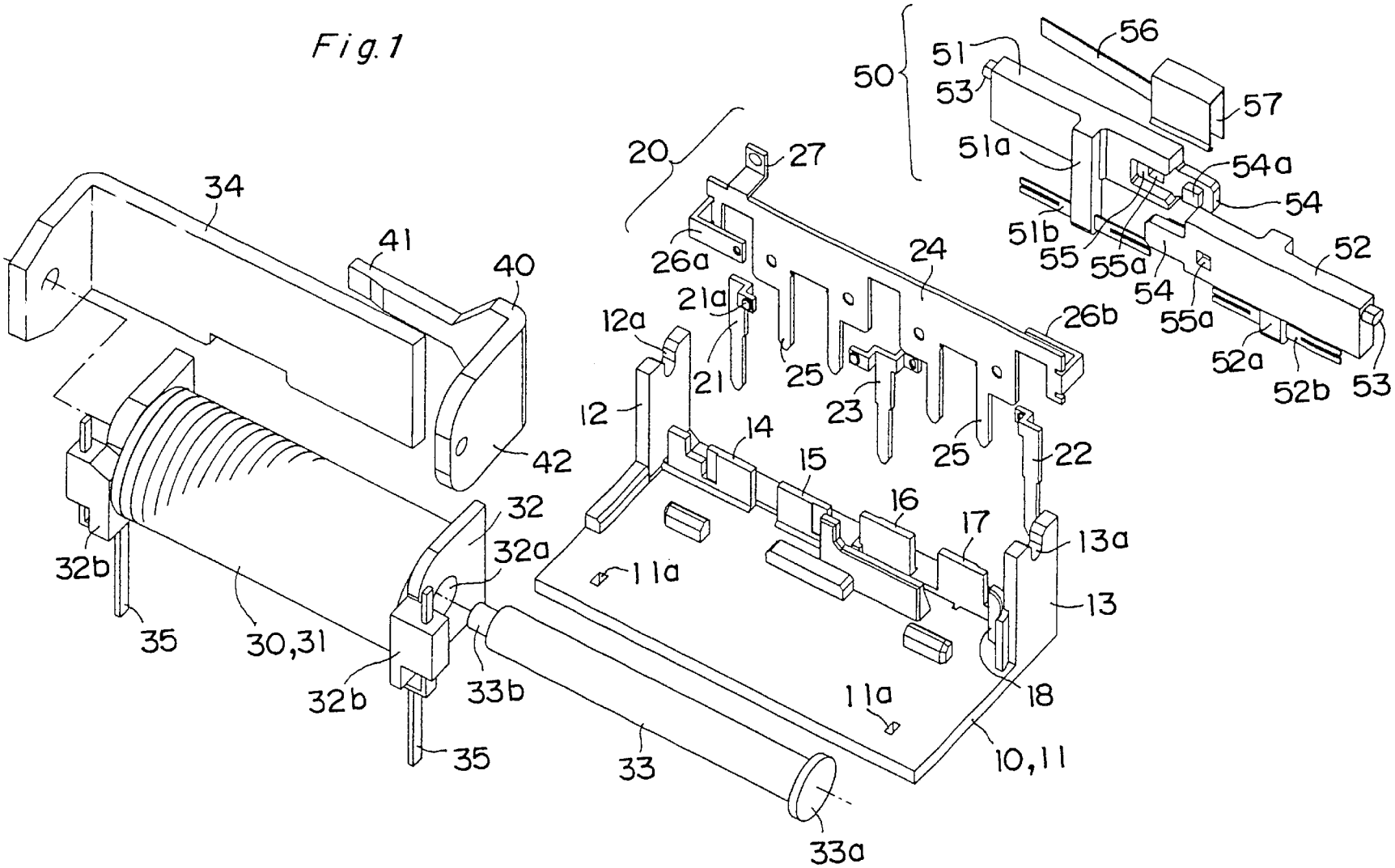
FIG. 1 is an exploded perspective view showing a first embodiment of the high-frequency use switch of the present invention.

Embodiments of the present invention will be described next with reference to the accompanying drawings of FIG. 1 through FIG. 35.

As shown in FIG. 1 through FIG. 9, a first embodiment is constructed roughly of a base 10, a fixed contact mechanism 20, an electromagnet block 30, an armature 40, a movable block 50 and a casing 60.

The base 10 is provided with support walls 12 and 13 that project at the corner portions on the opposite sides of a flat base body 11 made of a dielectric (synthetic resin) and with discontinuous insulating walls 14, 15, 16 and 17 arranged between them. Upper end portions of the support walls 12 and 13 are formed with bearing grooves 12*a* and 13*a,* respectively, for pivotally supporting the movable block 50 described later. A base portion of the support wall 13 is formed with a positioning use projecting portion 18 provided with an arc surface that serves as a pivot support of the armature 40 described later.

The fixed contact mechanism 20 is constructed of identically-shaped fixed contact terminals 21 and 22 having fixed contacts 21*a* and 22*a,* respectively, a common fixed contact terminal 23 having common fixed contacts 23*a* and 23*b* and a shield plate 24.

In particular, the fixed contact 21*a* and the common fixed contact 23*a* constitute a normally-open fixed contact mechanism, while the fixed contact 22*a* and the common fixed contact 23*b* constitute a normally-closed fixed contact mechanism.

Figure 6:
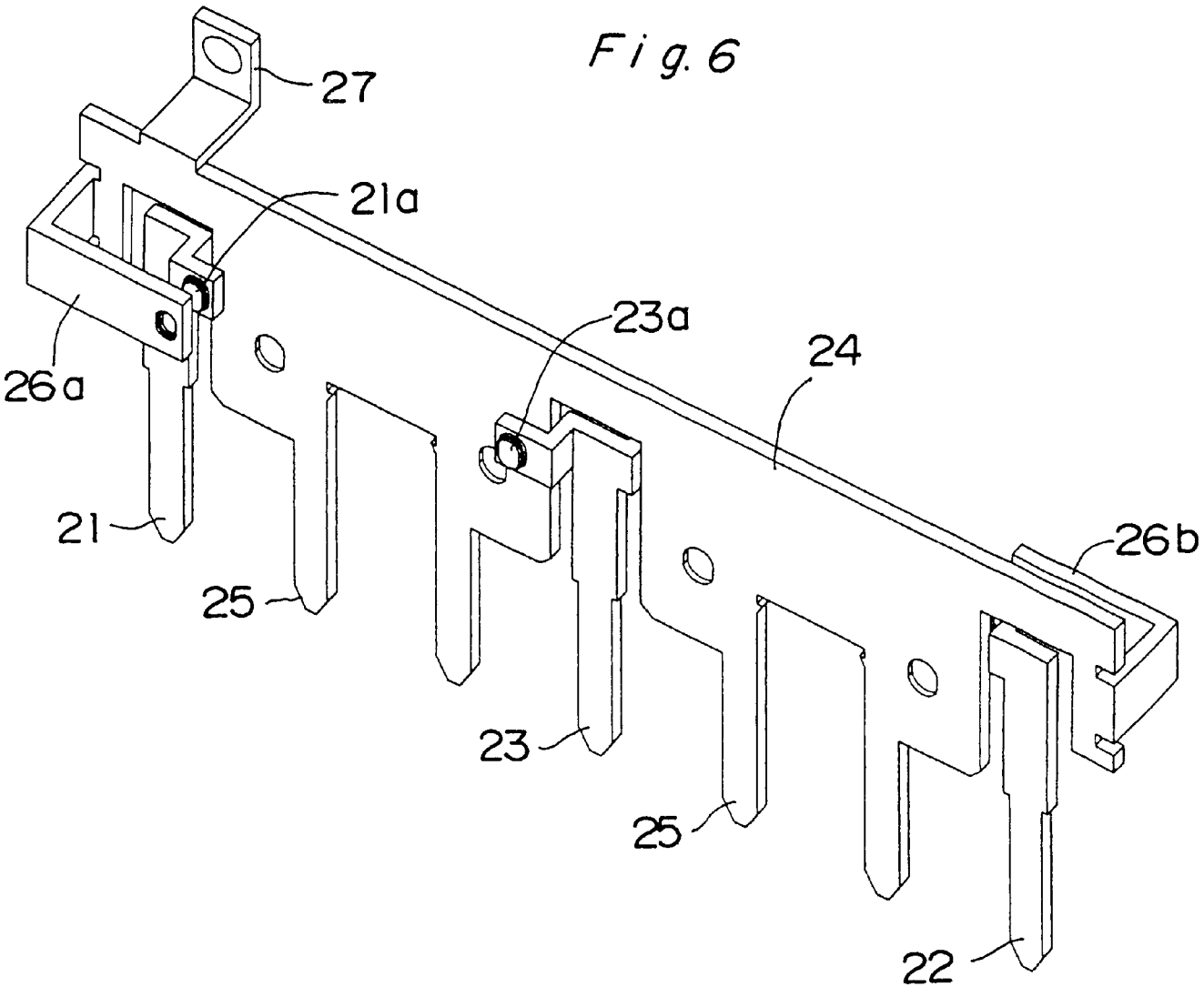
FIG. 6 is a perspective view of the fixed contact mechanism shown in FIG. 1.
Figure 7:
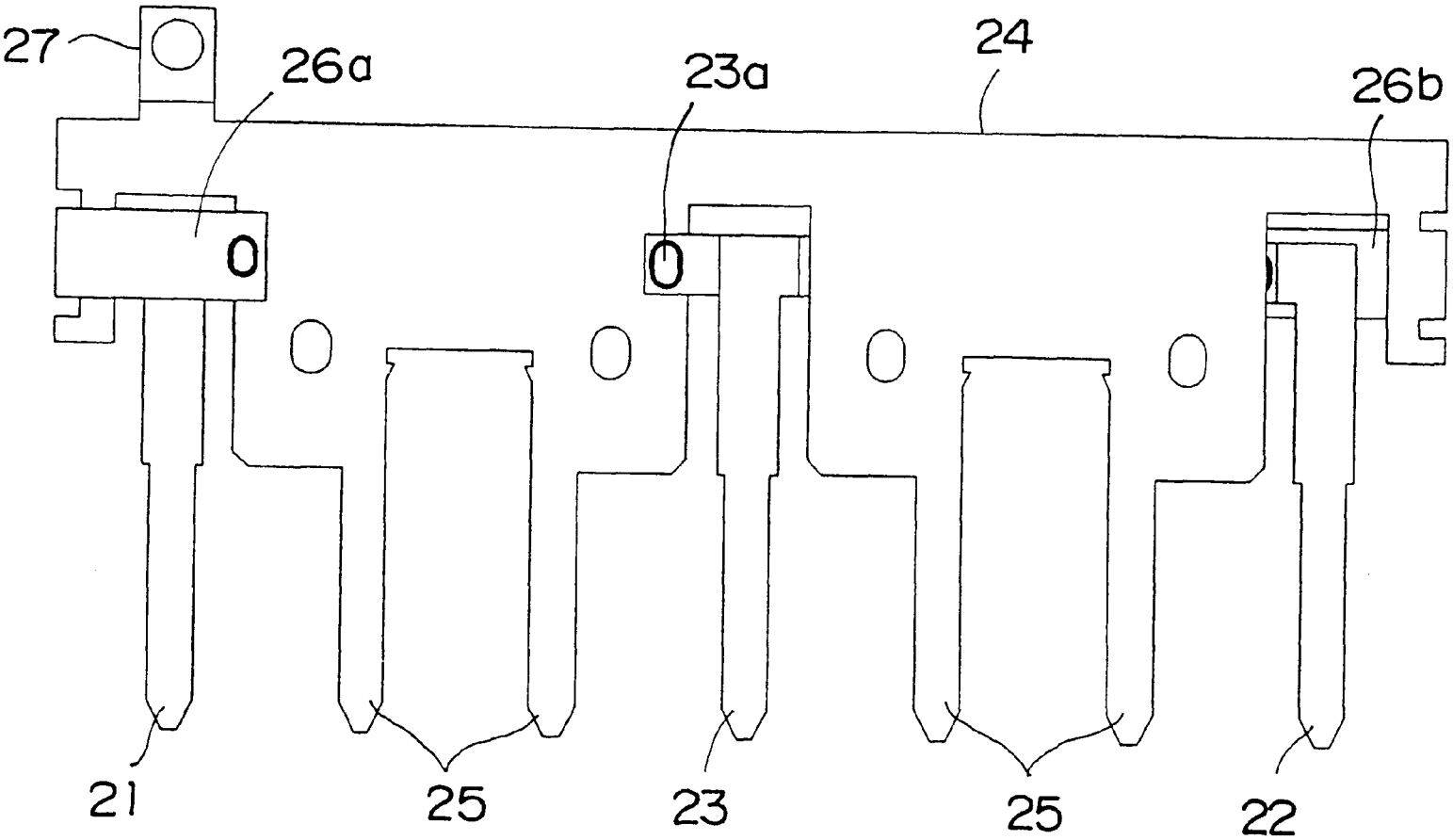
FIG. 7 is a front view of FIG. 6.

As shown in FIG. 6 and FIG. 7, the shield plate 24 is formed by punching a plate-shaped conductive material into a specified shape and press-processing the same. Then, the shield plate 24 has a plurality of ground terminals 25 projecting in line with one another on the lower side and ground tongues 26*a* and 26*b* formed by inwardly bending extended both end portions. Further, an engagement pawl 27 to be engaged with a restoration spring 56 for the movable block 50, described later, is projecting from an upper edge portion of the shield plate 24.

Figure 5:
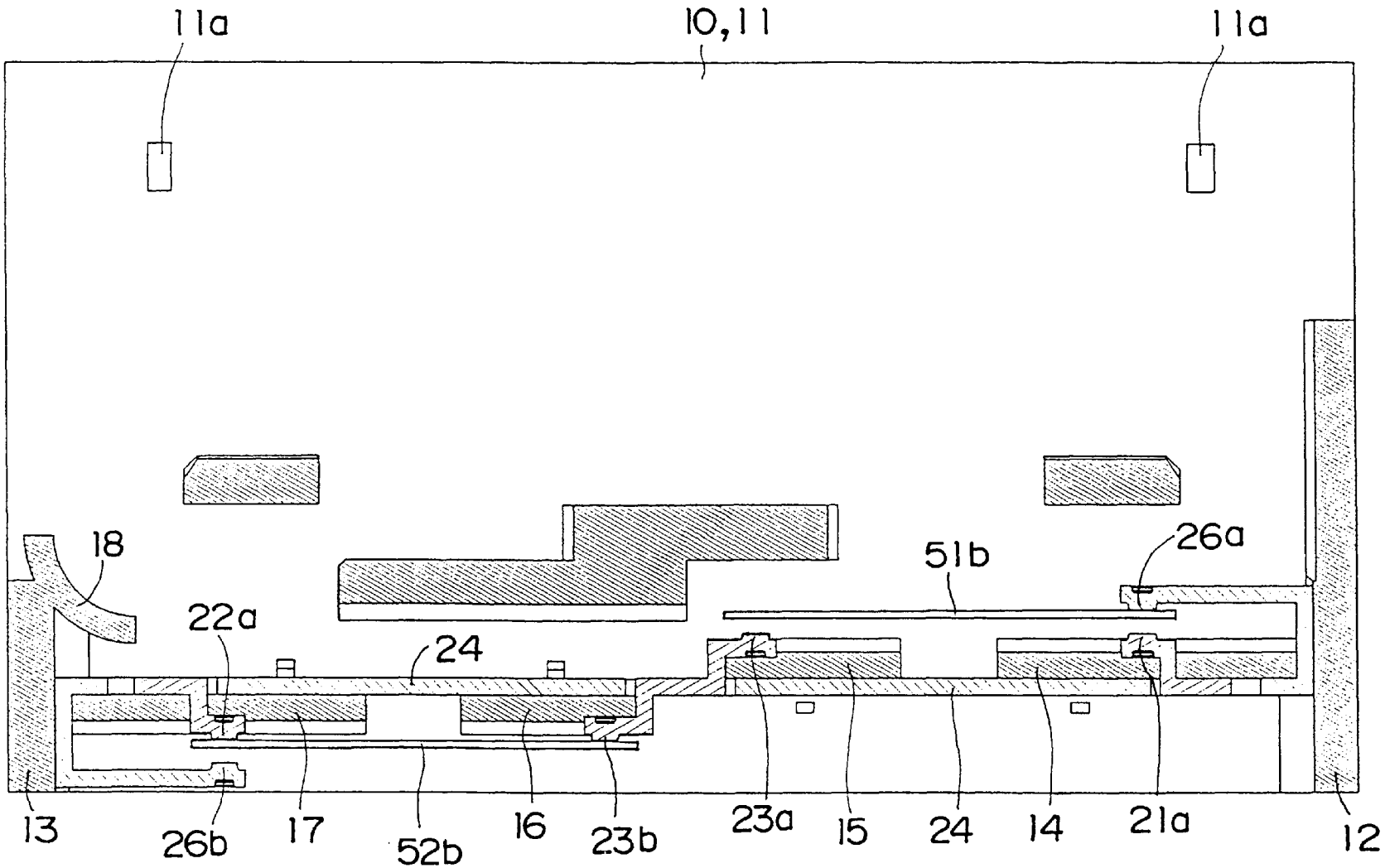
FIG. 5 is a plan view of FIG. 4.

By press-fitting the lower end portions of the fixed contact terminals 21 and 22 and the common fixed contact terminal 23 as well as the ground terminals 25 of the shield plate 24 into terminal holes of the base 10, then, as shown in FIG. 5, the lower end portions of the fixed contact terminals 21 and 22, the common fixed contact terminal 23 and the ground terminals 25 are arranged in line with one another. Further, the fixed contacts 21*a* and 22*a* and the common fixed contacts 23*a* and 23*b* abut against the side surfaces of the insulating walls 14 and 17 and the insulating walls 15 and 16, respectively, thereby shielding one side of the fixed contacts 21*a* and 22*a* and the common fixed contacts 23*a* and 23*b*. With this arrangement, a shield structure utilizing the principle of the so-called strip line is obtained.

The electromagnet block 30 is formed by inserting an iron core 33 having a roughly. T-figured section shape into a center hole 32*a* of a spool 32 around which a coil 31 is wound. The one end portion projecting from the center hole 32*a* is made to serve as a magnetic pole piece 33*a,* while the projecting other end portion 33*b* is fixed in a caulking manner to one end portion of a yoke 34 bent roughly in an L-figured shape. Coil terminals 35 are press-fit into flange portions 32*b* of the spool 32, and a lead wire of the coil 31 is wound around and soldered to this.

Then, by press-fitting the coil terminals 35 into terminal holes 11*a* of the base 10, the electromagnet block 30 is positioned in the specified position.

The armature 40 is made of magnetic material and bent roughly in an L-figured shape, and its one end portion is formed into a narrowed portion 41.

The armature 40 is assembled from above along the positioning use projecting portion 18 that is projecting from the upper surface of the base. Therefore, the armature 40 is pivotally supported on the inner surface of the positioning use projecting portion 18 used as a support, and its one end portion 42 can abut against the magnetic pole piece 33*a* of the iron core 33.

Figure 8:
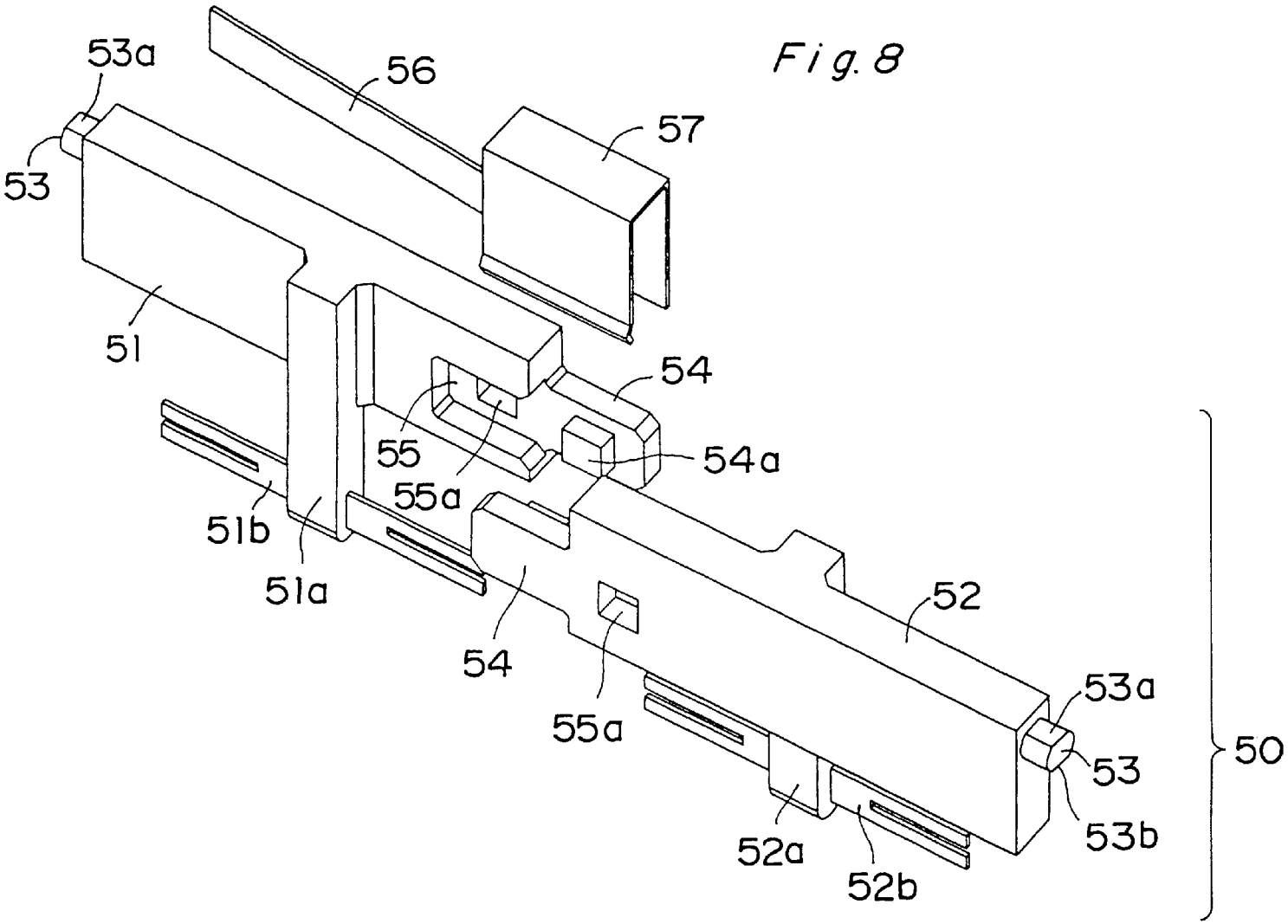
FIG. 8 is an exploded perspective view of the movable block shown in FIG. 1.

As shown in FIG. 8, the movable block 50 is made of a pair of movable bases 51 and 52 having an identical shape and a restoration spring 56.

The movable bases 51 and 52 are constructed so that movable contactors 51*b* and 52*b* are insert-molded into the lower end portions of projecting bars 51*a* and 52*a* extended downward from the side surfaces. The movable bases 51 and 52 have shaft portions 53 that project laterally from their one side end portions as well as engagement use projecting portions 54 and 54 that project laterally from their other side end portions.

The shaft portions 53 have an escape formed with flat surfaces 53*a* and 53*b* that are vertically parallel to each other. Further, a burr that cannot be avoided in the resin forming process is generated on the flat surfaces 53*a* and 53*b,* thereby allowing a smooth pivoting operation to be obtained.

The base portion of the engagement use projecting portion 54 is formed with a recess portion 55 to be engaged therewith. Further, the projecting portion 54 is formed with a projection 54*a* to be press-fit into the through hole 55*a* formed in a recess portion 55 for the engagement.

Then, the projecting portion 54 of the movable base 51 is positioned while being fit in the recess portion 55 of the movable base 52. Then, the projection 54*a* and the through hole 55*a* of the movable base 51 are press-fit on the through hole 55*a* and the projection 54*a* of the movable base 52, temporarily fixed and thereafter connected and integrated with each other by adhesive, high-frequency welding or other means.

Further, by mounting a gripping portion 57 of the restoration spring 56 on the upper edge portions of the movable bases 51 and 52 that have been connected and integrated with each other, the movable block 50 is completed.

According to the present embodiment, the movable bases 51 and 52 having the identical shape are used, and accordingly, there is the advantage that the resin molding is simplified and the manufacturing of the metal mold can be facilitated.

Then, the shaft portions 53 and 53 of the movable block 50 are fit into the bearing grooves 12*a* and 13*a* of the base 10, thereby pivotally supporting the movable block 50 in the direction of its thickness. With this arrangement, the movable contactor 51*b* faces the fixed contacts 21*a* and 23*a* or the ground tongue 26*a* while being able to come into and out of contact alternately with them. On the other hand, the movable contactor 52*b* faces the fixed contacts 22*a* and 23*b* or the ground tongue 26*b* while being able to come into and out of contact alternately with them. Then, the tip portion of the restoration spring 56 is engaged with the engagement pawl 27 of the shield plate 24, thereby urging the movable block 50 toward the electromagnet block 30 side.

Figure 9A:
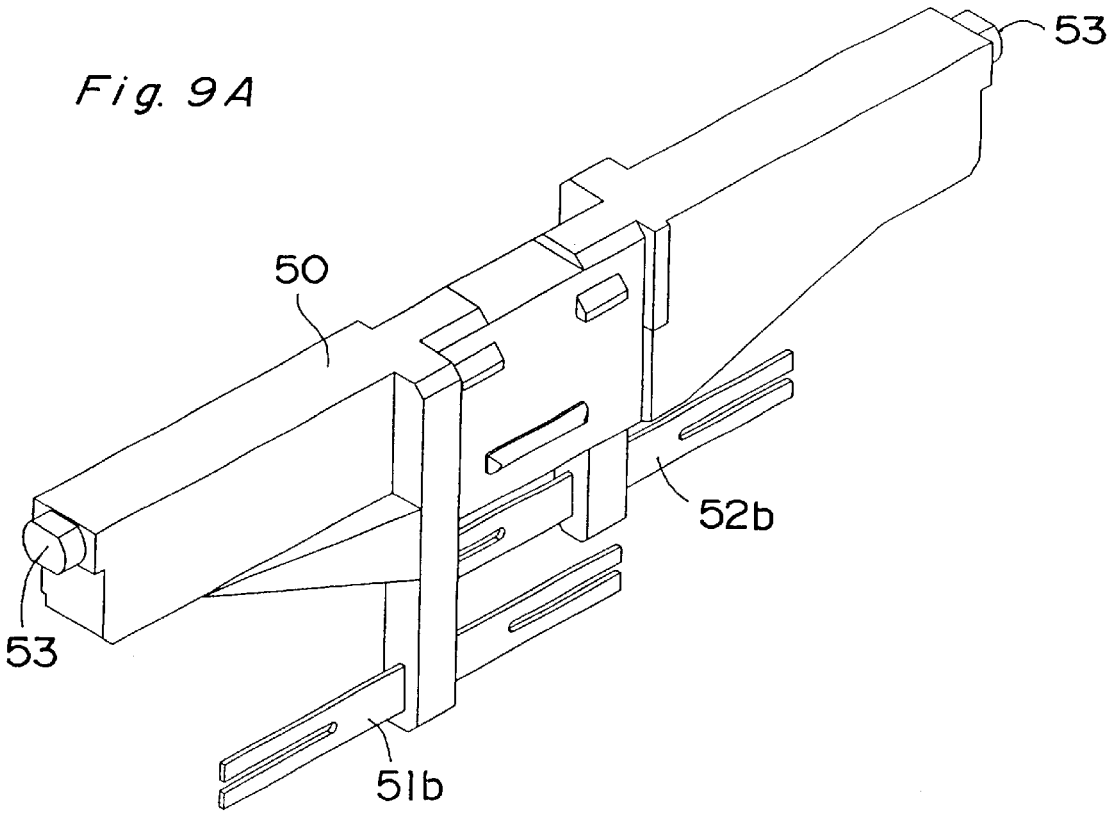
FIG. 9A is a perspective view of a movable block according to another embodiment.
Figure 9B:
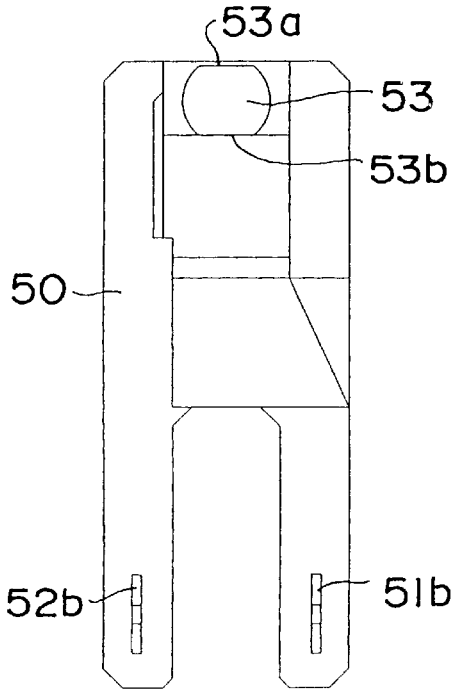
FIG. 9B is a side view thereof.
Figure 10:
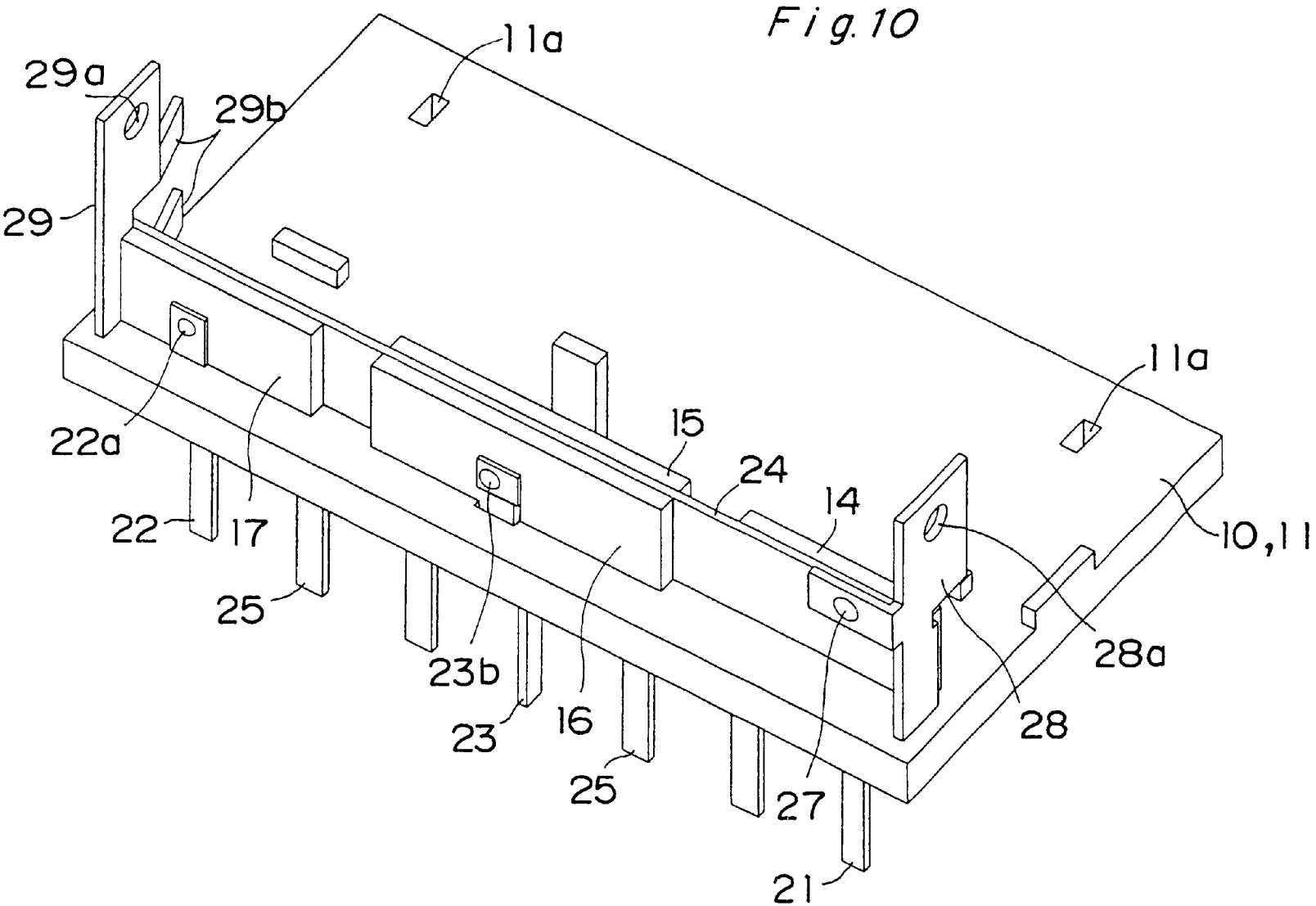
FIG. 10 is a perspective view showing a second embodiment.

Although: the aforementioned embodiment has been described on the basis of the case where the movable block 50 is formed by combining the two movable bases 51 and 52 with each other, the present invention is not always limited to this. As shown in FIGS. 9A and 9B, the movable block 50 may be integrally formed originally. According to this embodiment, the movable block 50 having a high dimensional accuracy free of any assembling error as observed in the aforementioned embodiment can be obtained. This arrangement has the advantage that a high-frequency use switch of uniform operation characteristics can be obtained.

Figure 2:
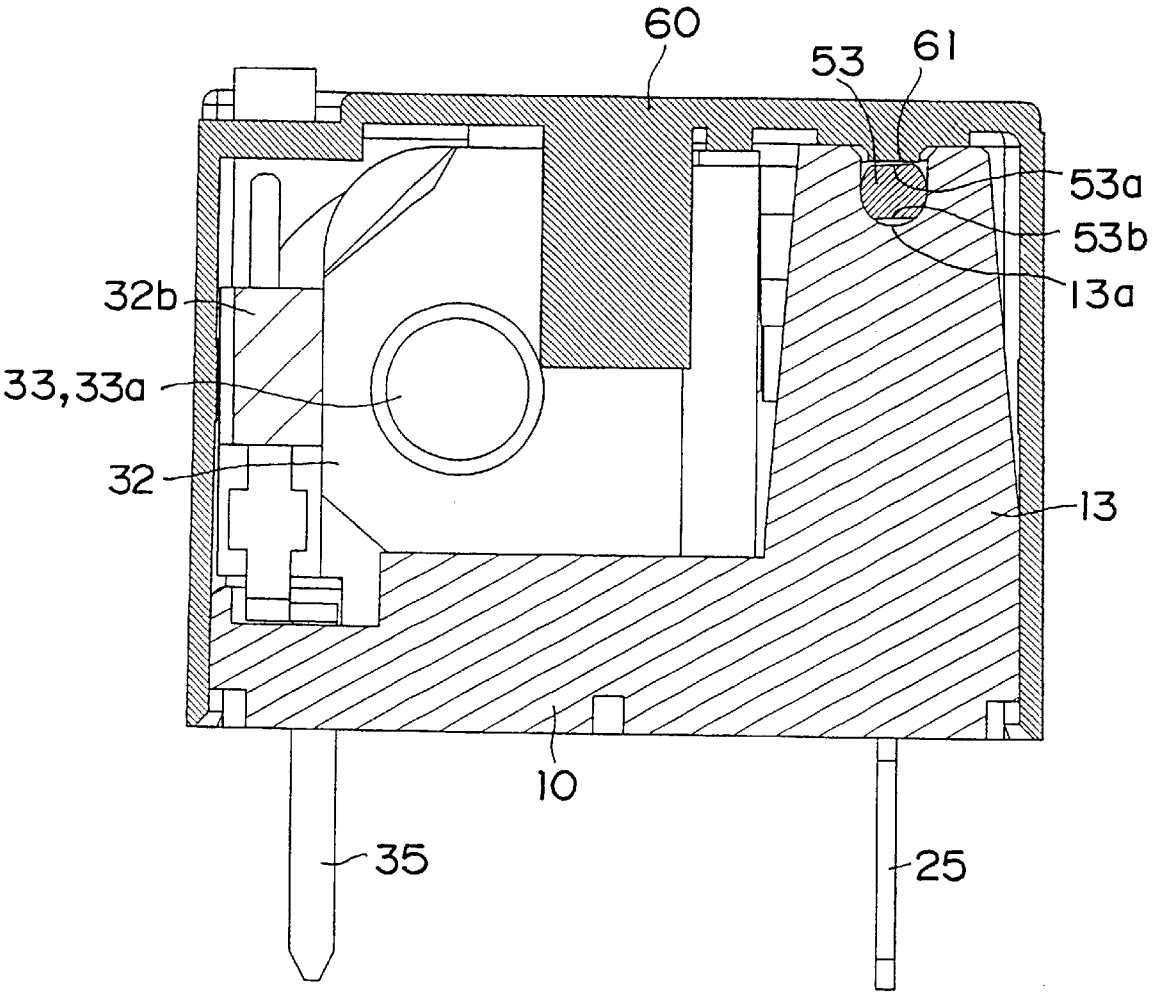
FIG. 2 is a cross sectional view of the high-frequency use switch shown in FIG. 1.
Figure 3:
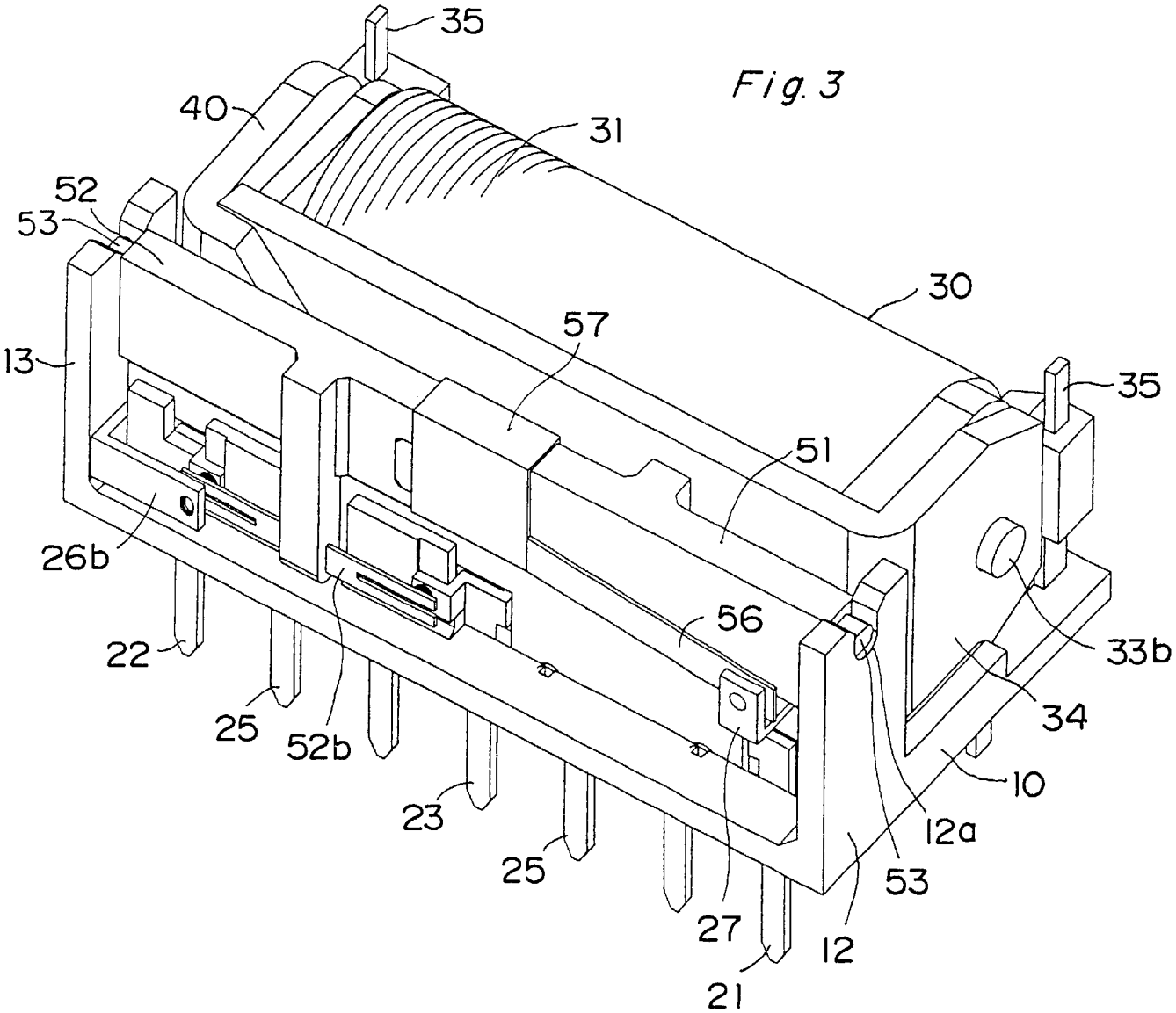
FIG. 3 is a perspective view of the high-frequency use switch shown in FIG. 1.
Figure 4:
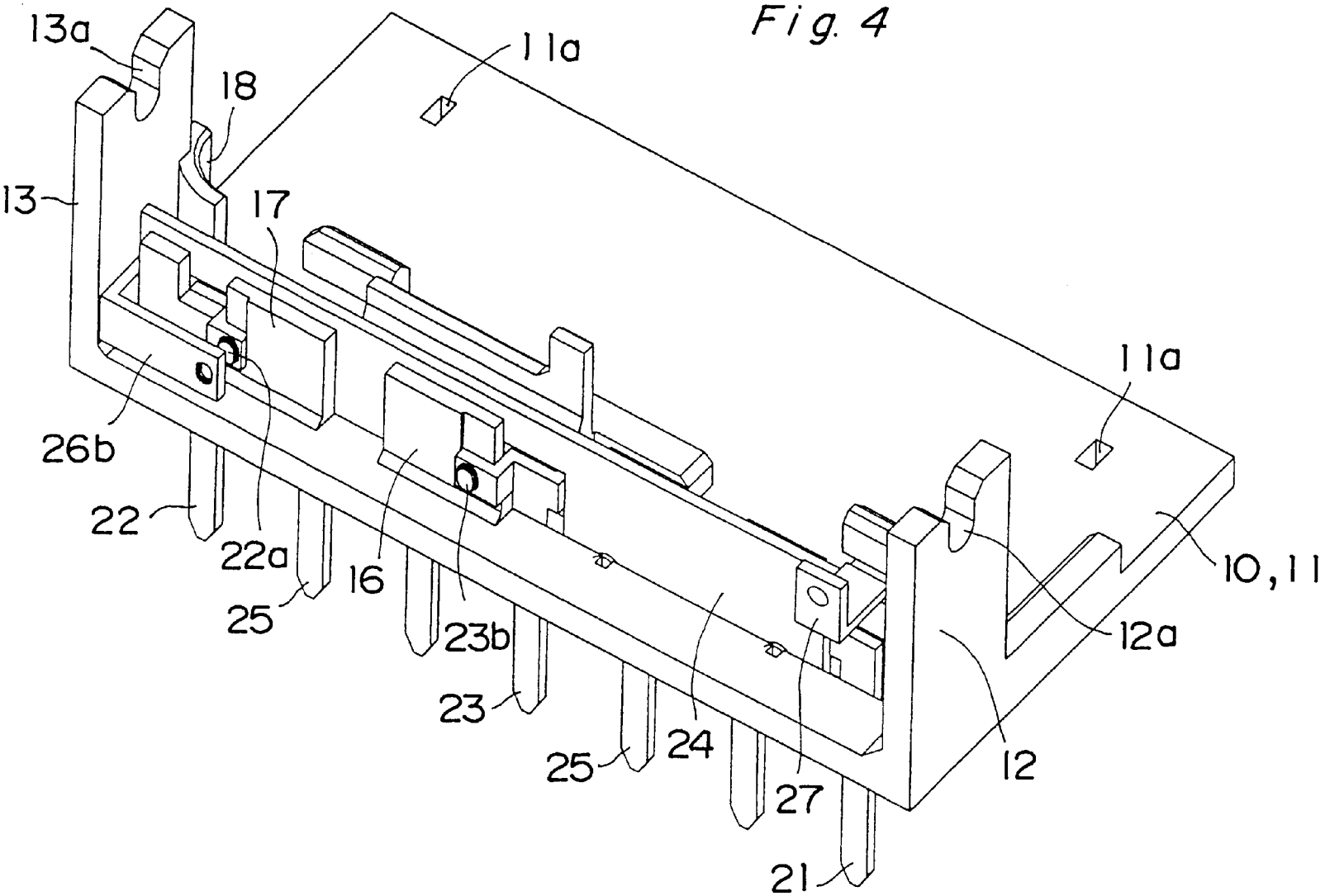
FIG. 4 is a perspective view showing a state in which the electromagnet block is dismounted from the high-frequency use switch of FIG. 3.

The casing 60 has a box-like shape that can fit on the base 10, and portions that belong to its ceiling surface and are located just above the shaft portions 53 of the movable block 50 are provided with a positioning use projecting portion 61 for preventing a lift (see FIG. 2).

When the casing 60 is fit on the base 10 integrated with the internal components, the positioning use projecting portion 61 faces the flat surface 53*a* of the shaft portion 53 with a minute gap retained between them. Then, by sealing the contact surface of the base 10 and the casing 60 with a sealant, the assembling work is completed.

The operation of the high-frequency use switch having the aforementioned construction will be described next.

When no voltage is applied to the coil 31 of the electromagnet block 30, the movable block 50 is urged toward the electromagnet block 30 side by a spring force of the restoration spring 56. Then, the movable contactor 51*b* is put in contact with the ground tongue 26*a,* while the movable contactor 52*b* is put in contact with the fixed contacts 23*b* and 22*a.*

When a voltage is applied to the coil 31 for the excitation, the one end portion 42 of the armature 40 is attracted to the magnetic pole piece 33*a* of the iron core 33. By this operation, the armature 40 pivots to make its narrowed portion 41 press the movable block 50 outward against the spring force of the restoration spring 56. Consequently, the movable block 50 pivots around the shaft portions 53, and the movable contactor 51*b* separates from the ground tongue 26*a* and comes into contact with the fixed contacts 21*a* and 23*a*. On the other hand, the movable contactor 52*b* separates from the fixed contacts 23*b* and 22*a* and comes into contact with the ground tongue 26*b*. Thereafter, the one end portion 42 of the armature 40 is attracted to the magnetic pole piece 33*a* of the iron core 33.

Subsequently, if the application of the voltage to the coil 31 is stopped, then the movable block 50 pivots in the direction opposite to the pivotal direction by the spring force of the restoration spring 56. By this operation, the movable contactor 51*b* comes into contact with the ground tongue 26*a*, and the movable contactor 52*b* comes into contact with the fixed contacts 23*b* and 22*a,* achieving restoration into the original state.

In contrast to the aforementioned first embodiment in which the movable block 50 is pivotally supported by the support walls 12 and 13 that are integrally formed with the base 10, a second embodiment is as shown in FIG. 10 through FIG. 13, in which support flaps 28 and 29 extend from both end portions of a shield plate 24 that is arranged upright while being press-fit into the base 10 and the shaft portions 53 and 53 of the aforementioned movable block 50 are pivotally supported while being inserted in bearing holes 28*a* and 29*a* provided for the support flaps 28 and 29.

Figure 11:
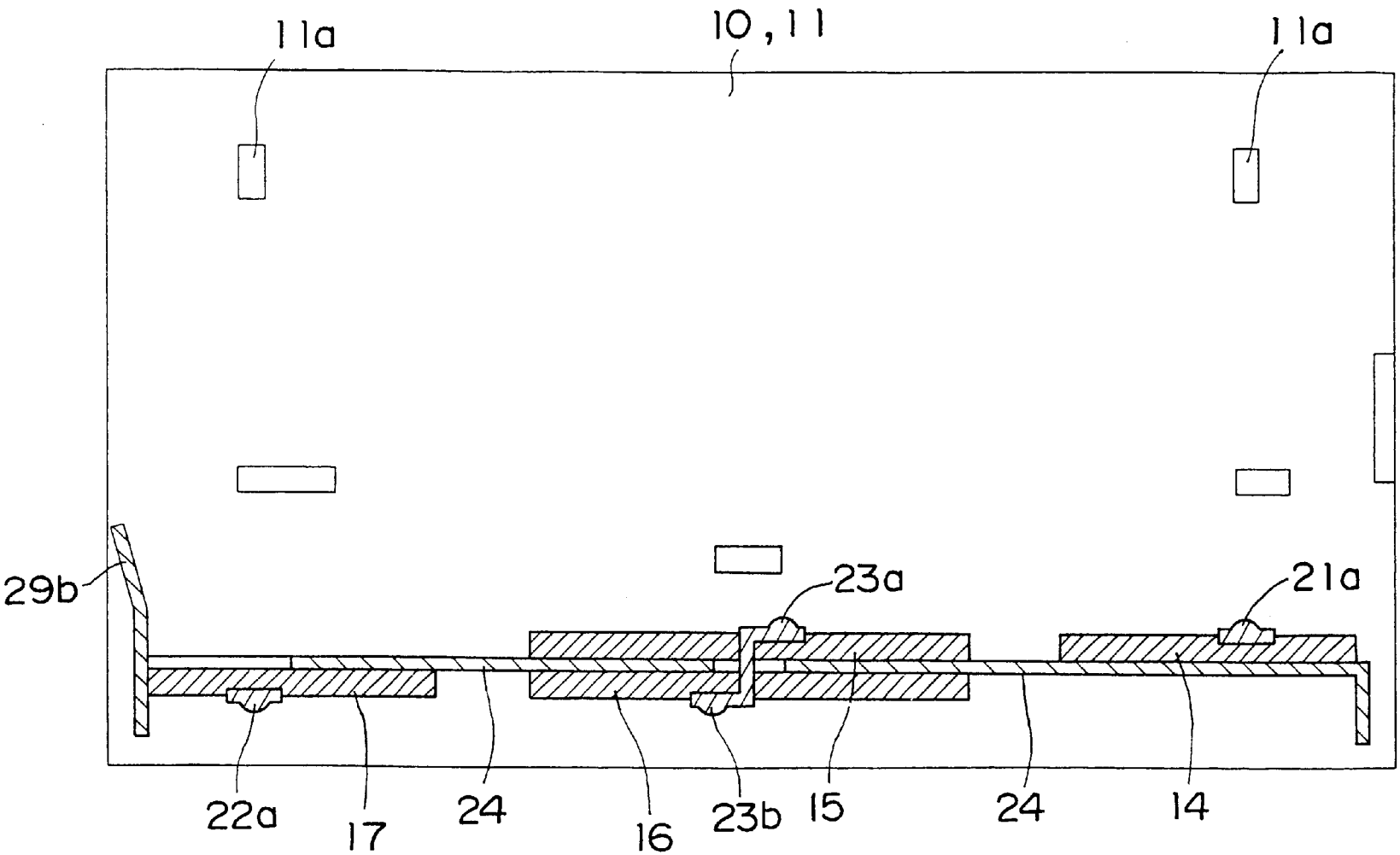
FIG. 11 is a plan view of FIG. 10.
Figure 12:
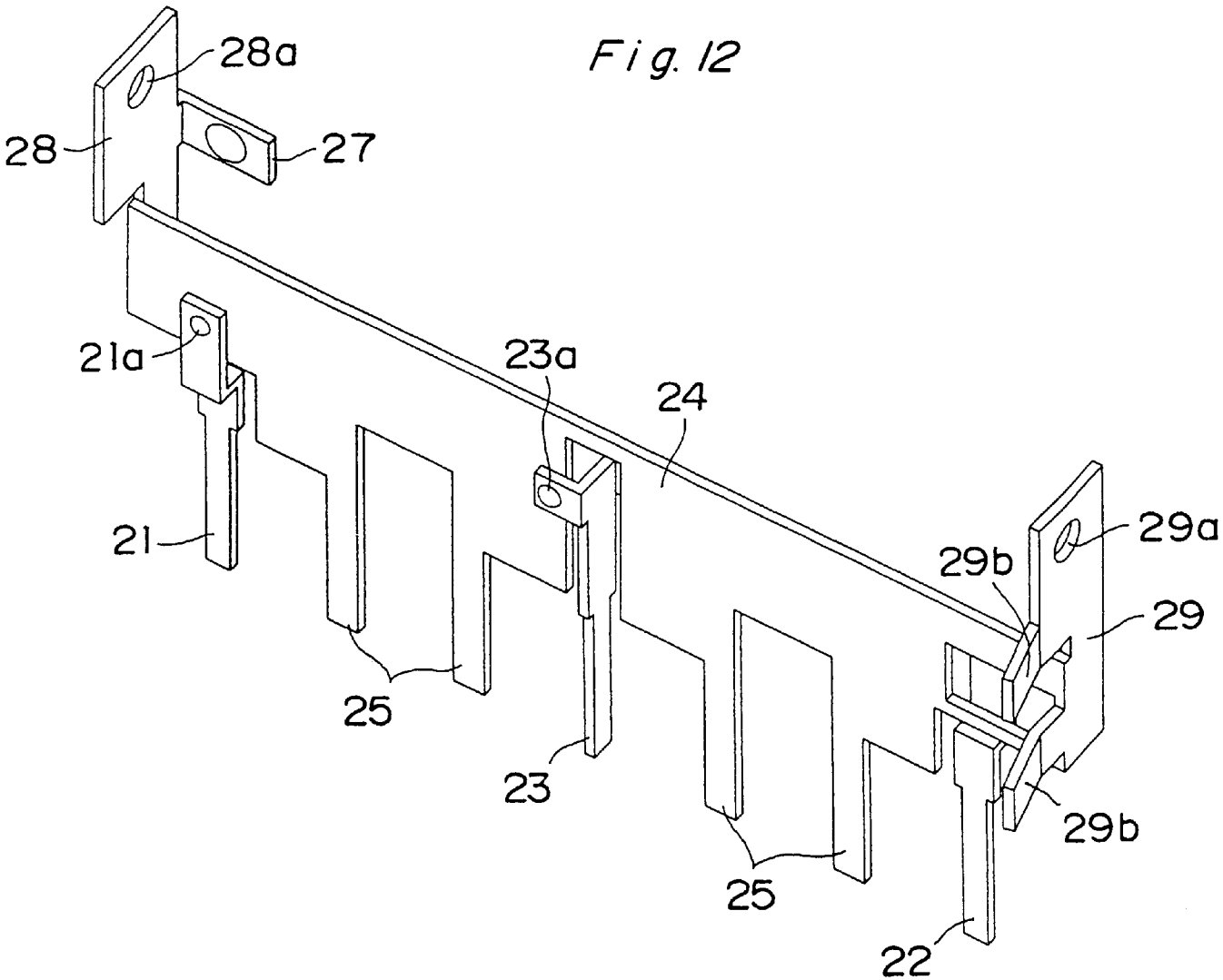
FIG. 12 is a perspective view of the fixed contact mechanism shown in FIG. 10.
Figure 13:
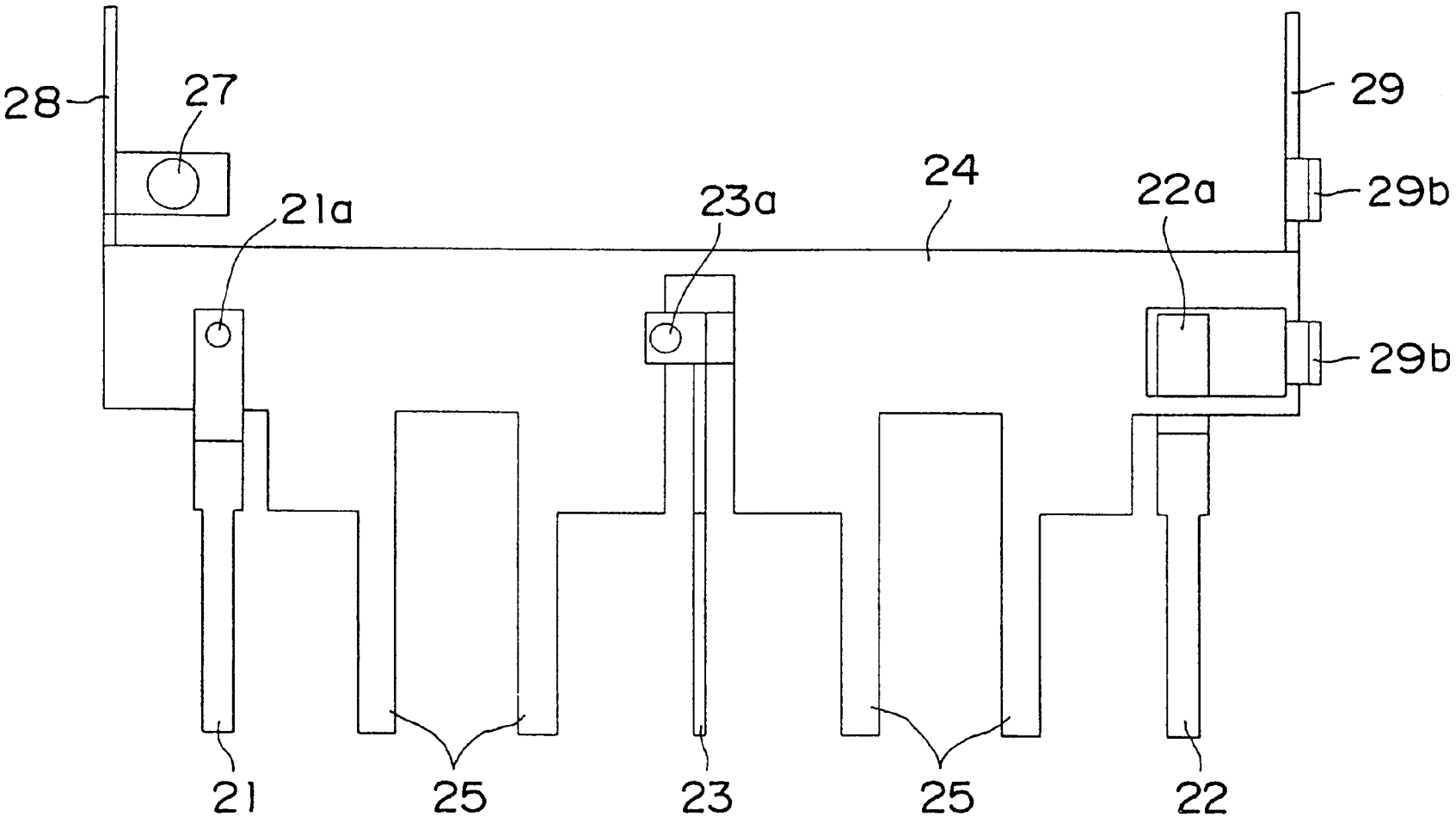
FIG. 13 is a front view of FIG. 12.

As shown in FIG. 11, similar to the aforementioned first embodiment, the back surfaces of the fixed contacts 21*a* and 22*a* and the common fixed contacts 23*a* and 23*b* abut against the insulating walls 14 and 17 and 15 and 16 projecting from the base 10, constituting a strip line in the present embodiment.

It is to be noted that the shield plate 24 has an engagement pawl 27 which is laterally extended from its support flap 28 and with which the free end portion of the restoration spring 56 is engaged. Further, the shield plate 24 has positioning tongues 29*b* which are laterally extended from the other support flap 29 and are brought in pressure contact with the bent corner portion of the armature 40 so as to pivotally support the armature.

According to the present embodiment, the fixed contact terminals 21 and 22 and the common fixed contact terminal 23 can be press-fit from below the base 10, while the shield plate 24 can be press-fit from above. This arrangement has the advantage that the degree of freedom in assembling expands. The other part is similar to that of the aforementioned first embodiment, and therefore, no description is provided therefor.

Figure 14:
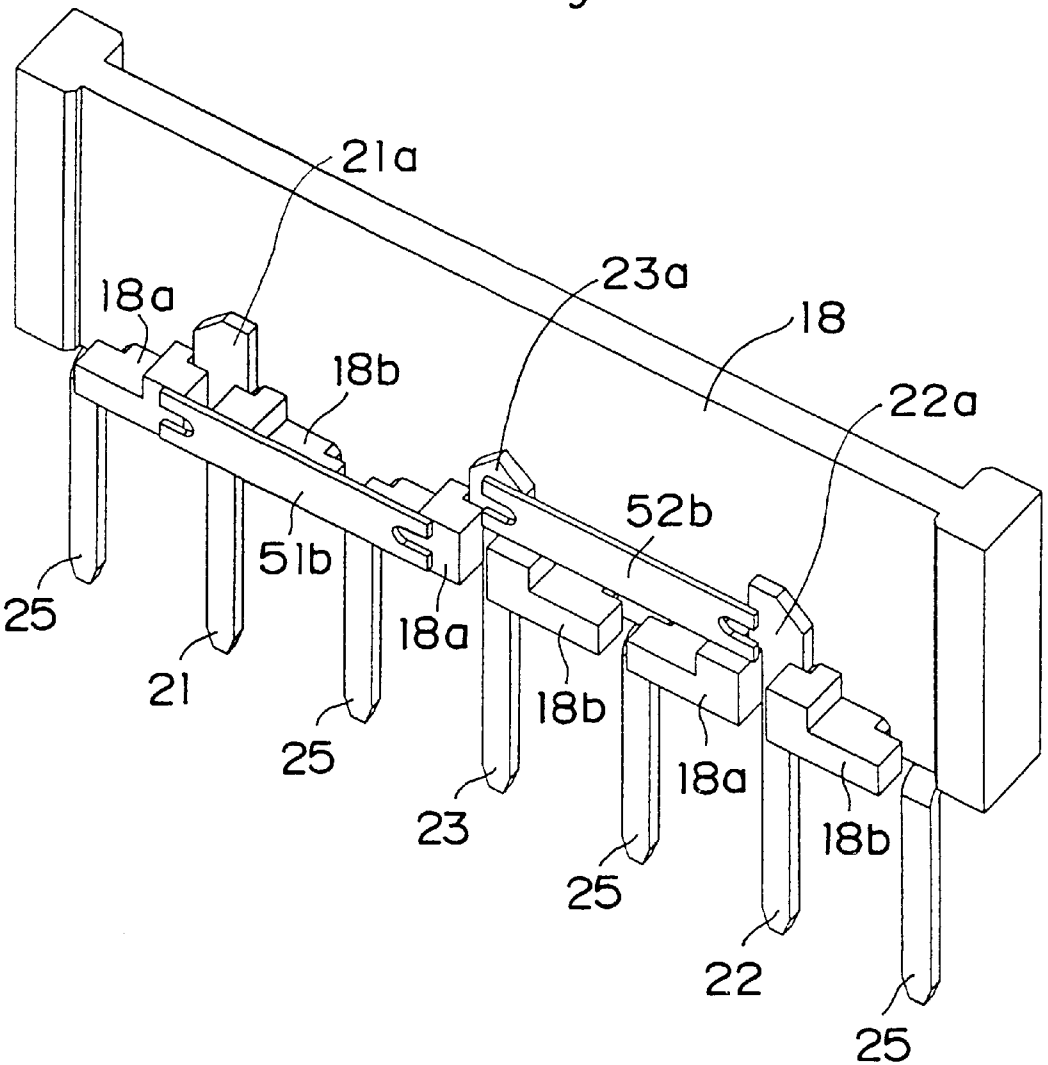
FIG. 14 is a perspective view of a third embodiment.
Figure 15:
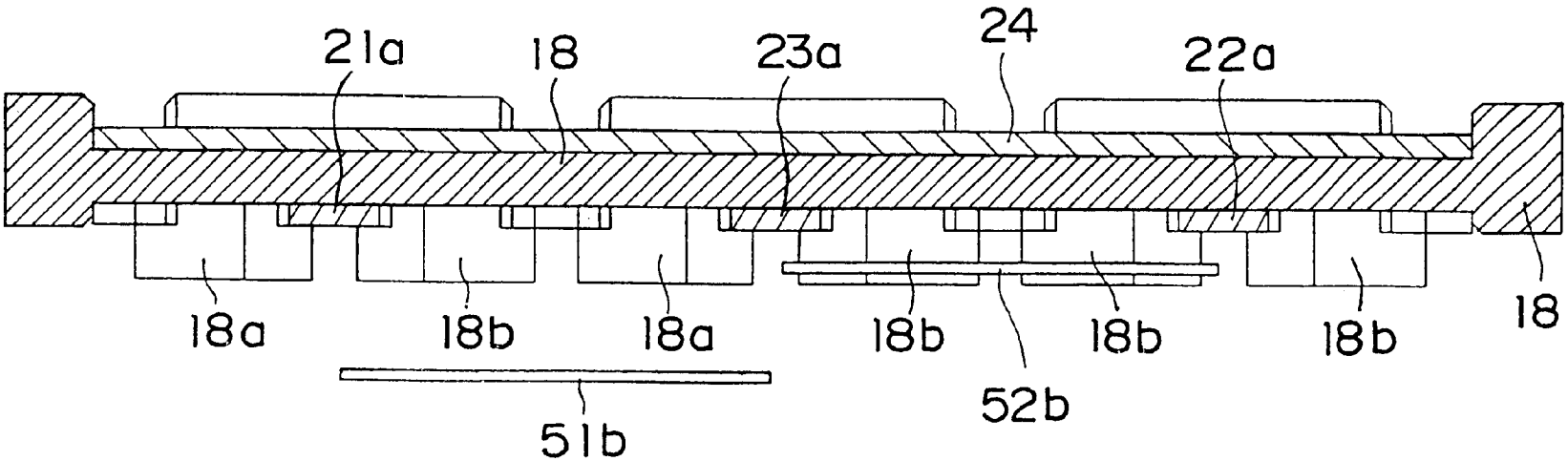
FIG. 15 is a sectional plan view of FIG. 14.

A third embodiment is as shown in FIG. 14 and FIG. 15, in which a strip line is constituted via an insulating wall 18 separated from the base 10.

That is, the fixed contact terminals 21 and 22 and the common fixed contact terminal 23 are press-fit between three pairs of press-fitting use projecting portions 18*a* and 18*b* projecting from lower edge portions of the surface of the insulating wall 18 of a synthetic resin mold, while a shield plate 24 is assembled with the back surface of the insulating wall 18.

Then, a movable contactor 51*b* or 52*b* that reciprocates in the direction of plate thickness on the basis of excitation and nonexcitation of the electromagnet block (not shown) is brought in and out of contact alternately with the fixed contacts 21*a* and 23*a* or the fixed contacts 23*b* and 22*a,* thereby opening and closing the contact.

Although the present embodiment has been described on the basis of the case where the insulating wall 18 is formed separately from the base 10. However, the present invention is not always limited to this, and the insulating wall may be integrally formed with the base 10.

Figure 16:
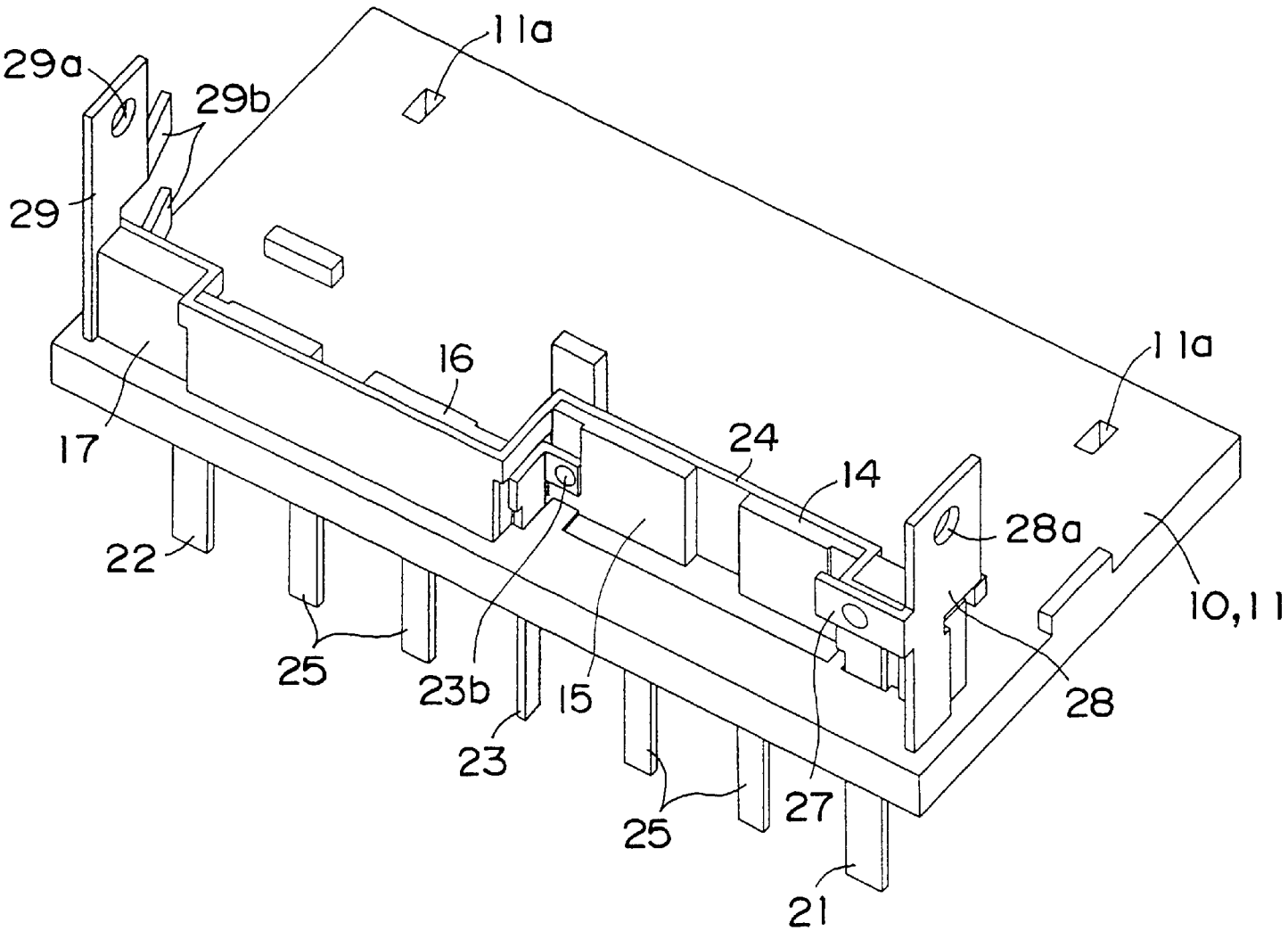
FIG. 16 is a perspective view of a fourth embodiment.
Figure 17:
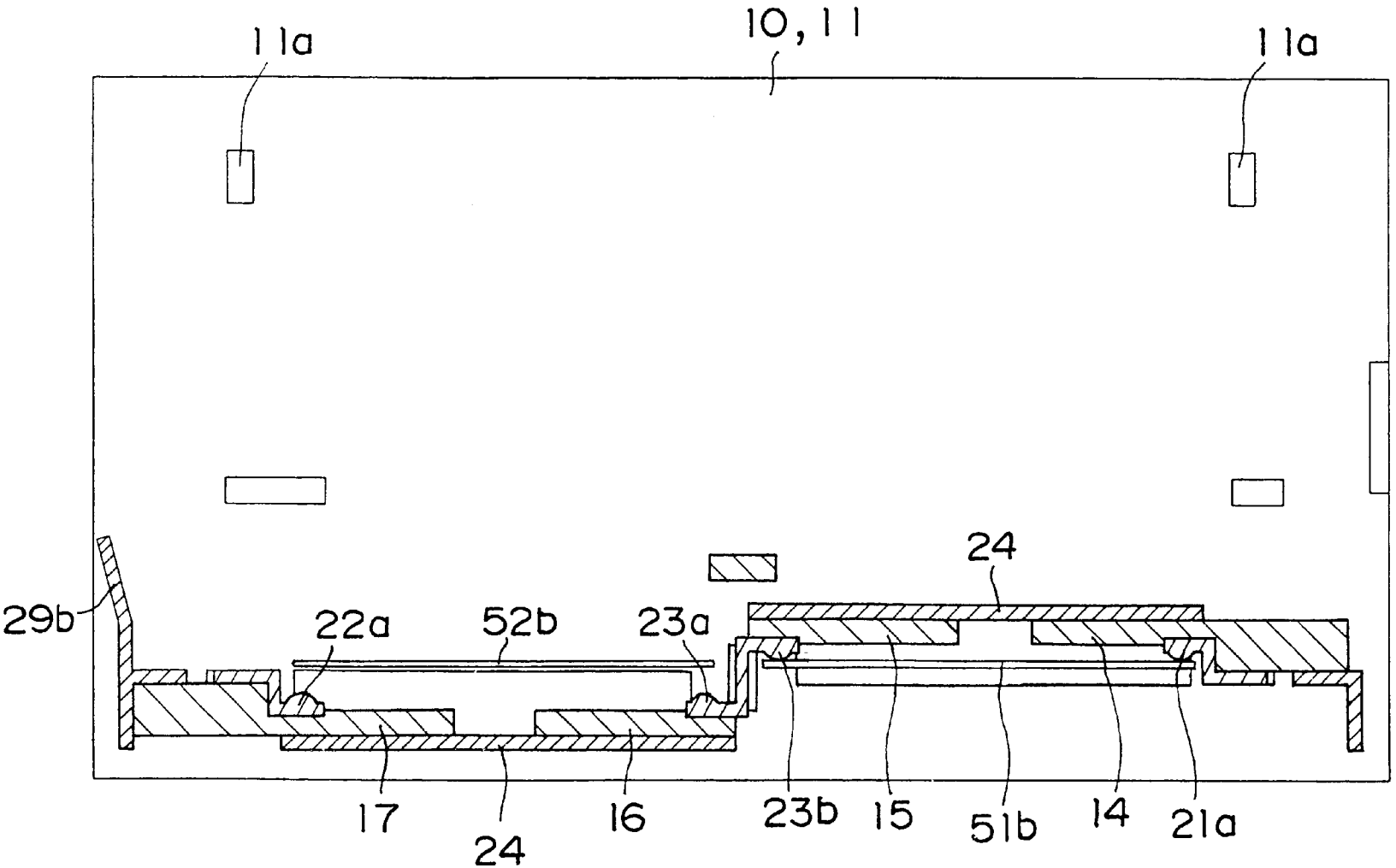
FIG. 17 is a plan view of FIG. 16.
Figure 18:
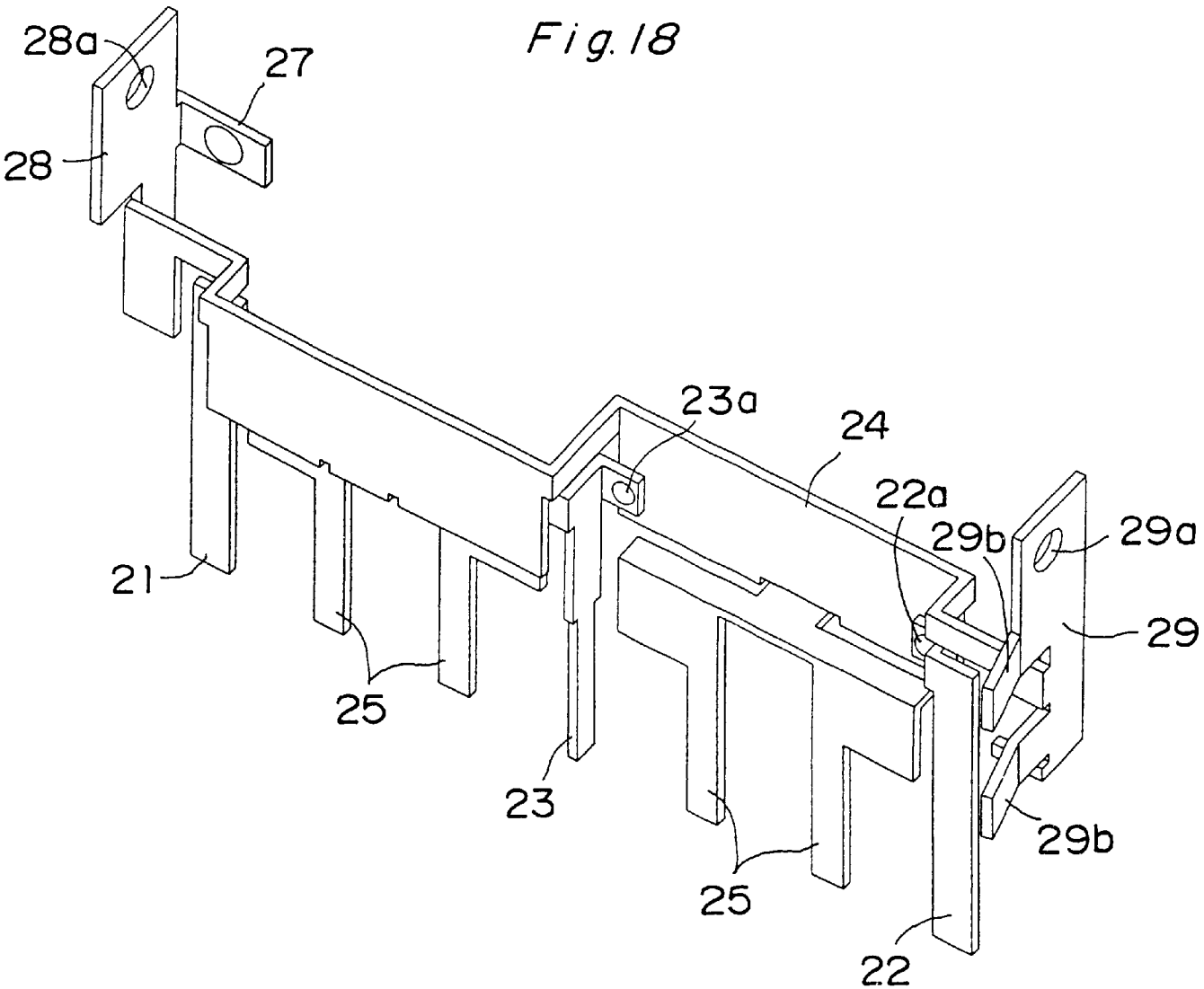
FIG. 18 is a perspective view of the fixed contact mechanism shown in FIG. 16.

A fourth embodiment is as shown in FIG. 16 through FIG. 18, in which movable contactors 51*b* and 52*b* are arranged in line with each other. Due to this arrangement, the insulating walls 14, 15, 16 and 17 of the base 10 are projecting in correspondence with a shield plate 24 bent roughly in the middle portion thereof.

According to the present embodiment, the two movable contactors 51*b* and 52*b* are arranged in line with each other. This arrangement has the advantage that the manufacturing can be facilitated to allow a movable block having a high dimensional accuracy to be manufactured and allow the prevention of the occurrence of a variation in operation characteristics. The other part is similar to that of the aforementioned embodiment, and therefore, no description is provided therefor.

FIRST EXPERIMENTAL EXAMPLE

The high-frequency use switch having the shield structure described in connection with the first embodiment was measured with regard to its high-frequency characteristic in the case where the contact circuit corresponding to the movable contactor 51*b* was opened and in the case where the contact circuit was closed. The measurement results are shown in FIG. 19 and FIG. 20.

PRIOR ART EXAMPLE

The high-frequency use switch described in connection with the prior art was measured similar to the first experimental example with regard to its high-frequency characteristic in the case where the contact circuit corresponding to the movable contactor was opened and in the case where the contact circuit was closed. The measurement results are shown in FIG. 19 and FIG. 20.

Figure 19:
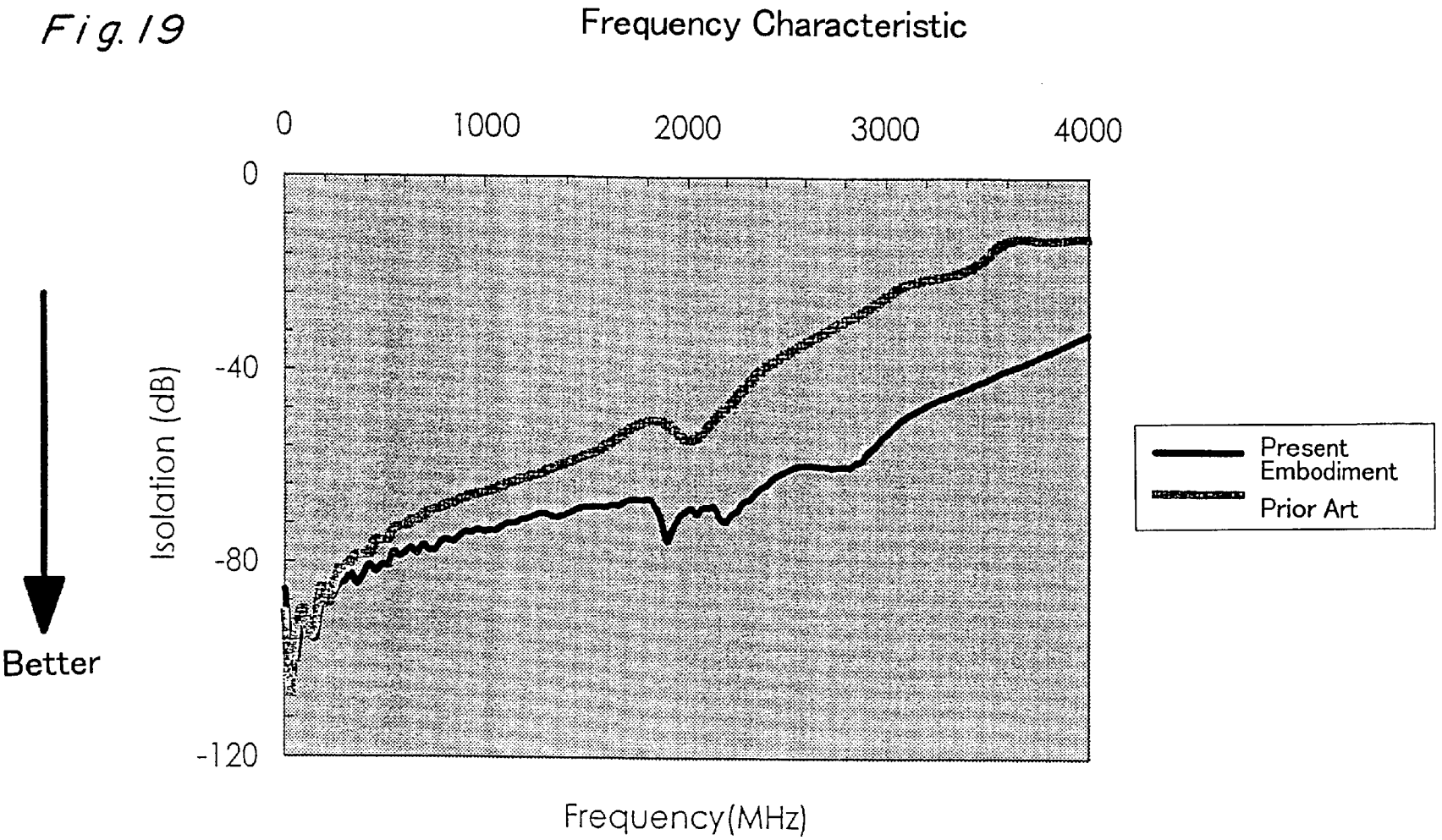
FIG. 19 is a graph showing measurement results of high-frequency characteristic in the case where the contact is opened.
Figure 20:
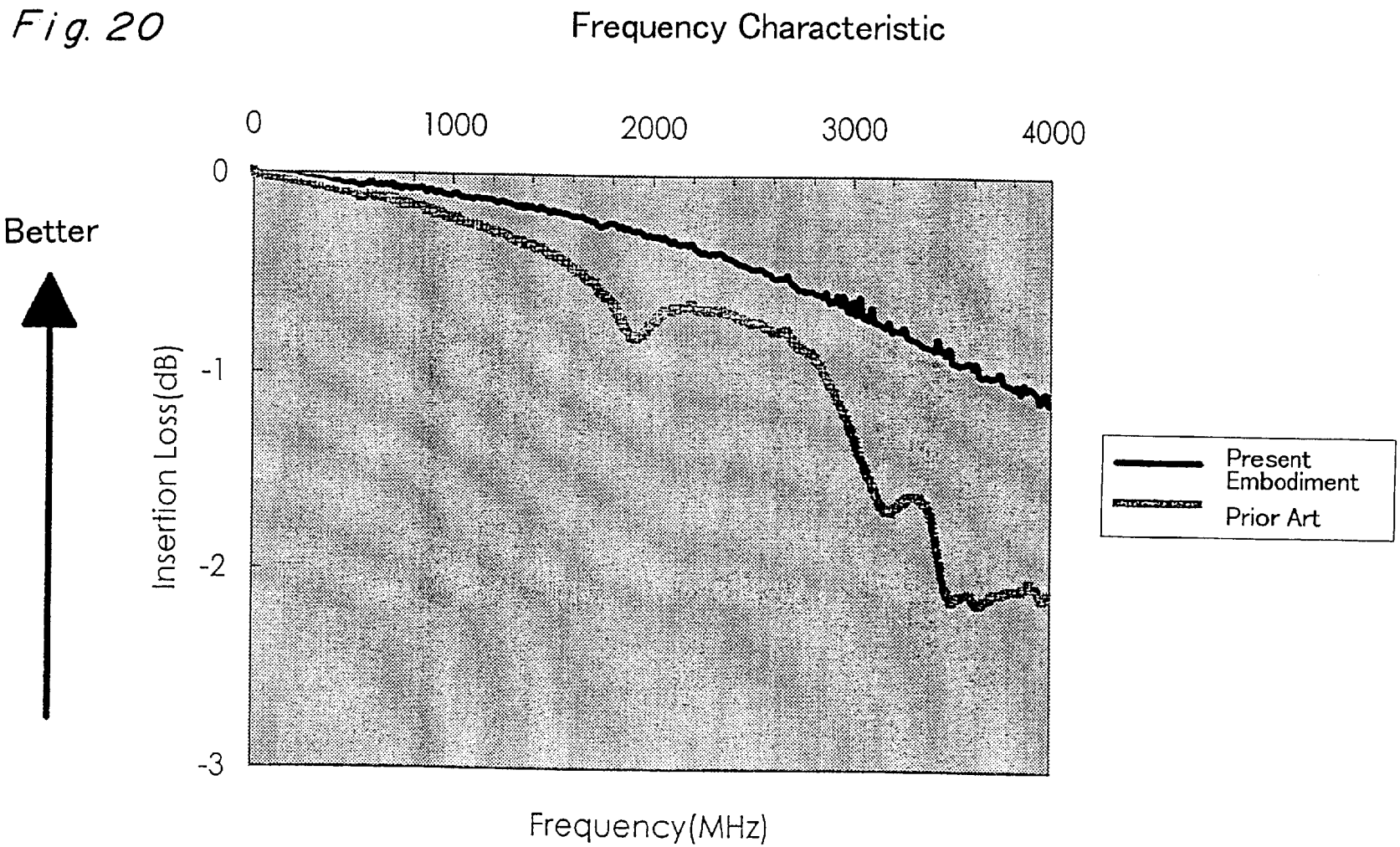
FIG. 20 is a graph showing measurement results of high-frequency characteristic in the case where the contact is closed.
Figure 21:
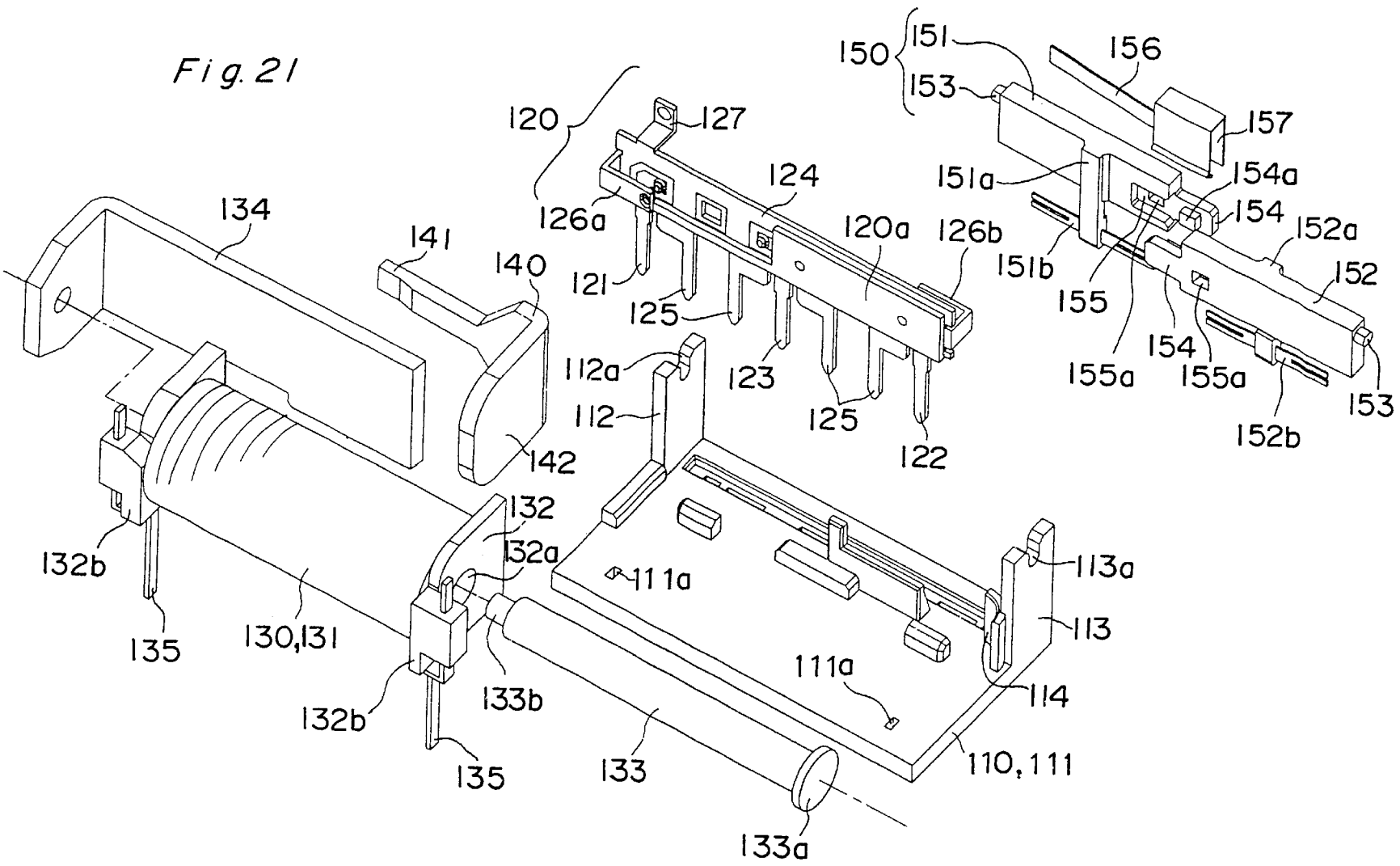
FIG. 21 is an exploded perspective view showing a fifth embodiment of the high-frequency use switch of the present invention.

As is apparent from FIG. 19, it can be found that the present first experimental example is always superior with regard to the high-frequency characteristic in the case where the contact is opened. The difference is remarkable particularly above 2000 MHz.

As is also apparent from FIG. 20, it can be found that the present first experimental example is always superior with regard to the high-frequency characteristic in the case where the contact is closed. The difference is remarkable particularly above 2000 MHz.

This can be considered to be ascribed to the fact that impedance matching can be attained almost throughout the entire range in the first experimental example as compared with the fact that impedance matching can be attained only partially in the prior art.

The dielectric positioned on the back surface of the fixed contact is not always required to be an insulating wall projecting from the base and is allowed to be a coating film or a sheet, which is made of a dielectric material and is laminated on the side surface of the shield plate.

As shown in FIG. 21 through FIG. 24, a high-frequency use switch according to a fifth embodiment is constructed roughly of a base 110, a fixed contact mechanism 120, an electromagnet block 130, an armature 140, a movable block 150 and a casing 160.

The base 110 is provided with support walls 112 and 113 that project at the corner portions on the opposite sides of a flat base body 111 made of a dielectric (synthetic resin) and terminal holes for arranging a fixed contact block 120 described later between them. Upper end portions of the support walls 112 and 113 are formed with bearing grooves 112*a* and 113*a,* respectively, for pivotally supporting the movable block 150 described later. A base portion of the support wall 113 is formed with a positioning use projecting portion 114 provided with an arc surface that serves as a pivot support of the armature 140 described later.

The fixed contact block 120 is constructed of identically-shaped fixed contact terminals 121 and 122 having fixed contacts 121*a* and 122*a,* respectively, a common fixed contact terminal 123 having fixed contacts 123*a* and 123*b* and a shield plate 24, which are integrally formed with a retainer 120*a* made of a synthetic resin, or a dielectric.

In particular, the fixed contact 121*a* and the common fixed contact 123*a* constitute a normally-open fixed contact mechanism, while the fixed contact 122*a* and the common fixed contact 123*b* constitute a normally-closed fixed contact mechanism.

The shield plate 124 is formed by punching a plate-shaped conductive material into a specified shape and press-processing the same. Then, the shield plate 124 has a plurality of ground terminals 125 projecting in line with one another on the lower side and ground tongues 126*a* and 126*b* formed by inwardly bending extended both end portions. Further, an engagement pawl 127 to be engaged with a restoration spring 156 for the movable block 150, described later, is projecting from an upper edge portion of the shield plate 124.

Figure 24:
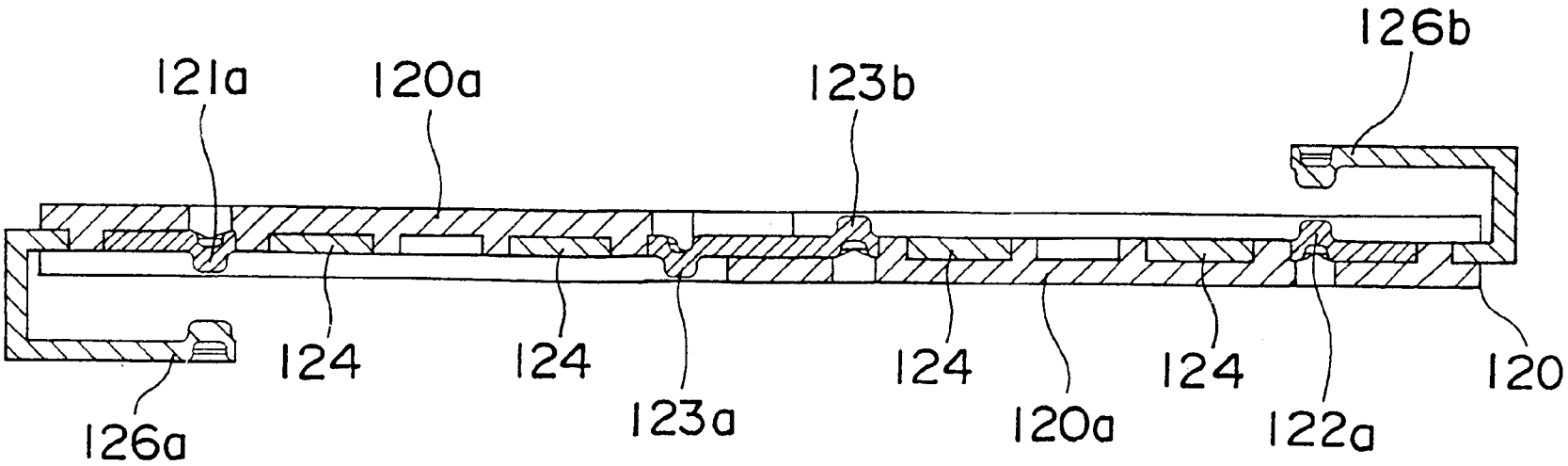
FIG. 24 is a cross sectional view of the fixed contact block shown in FIG. 21.
Figure 25:
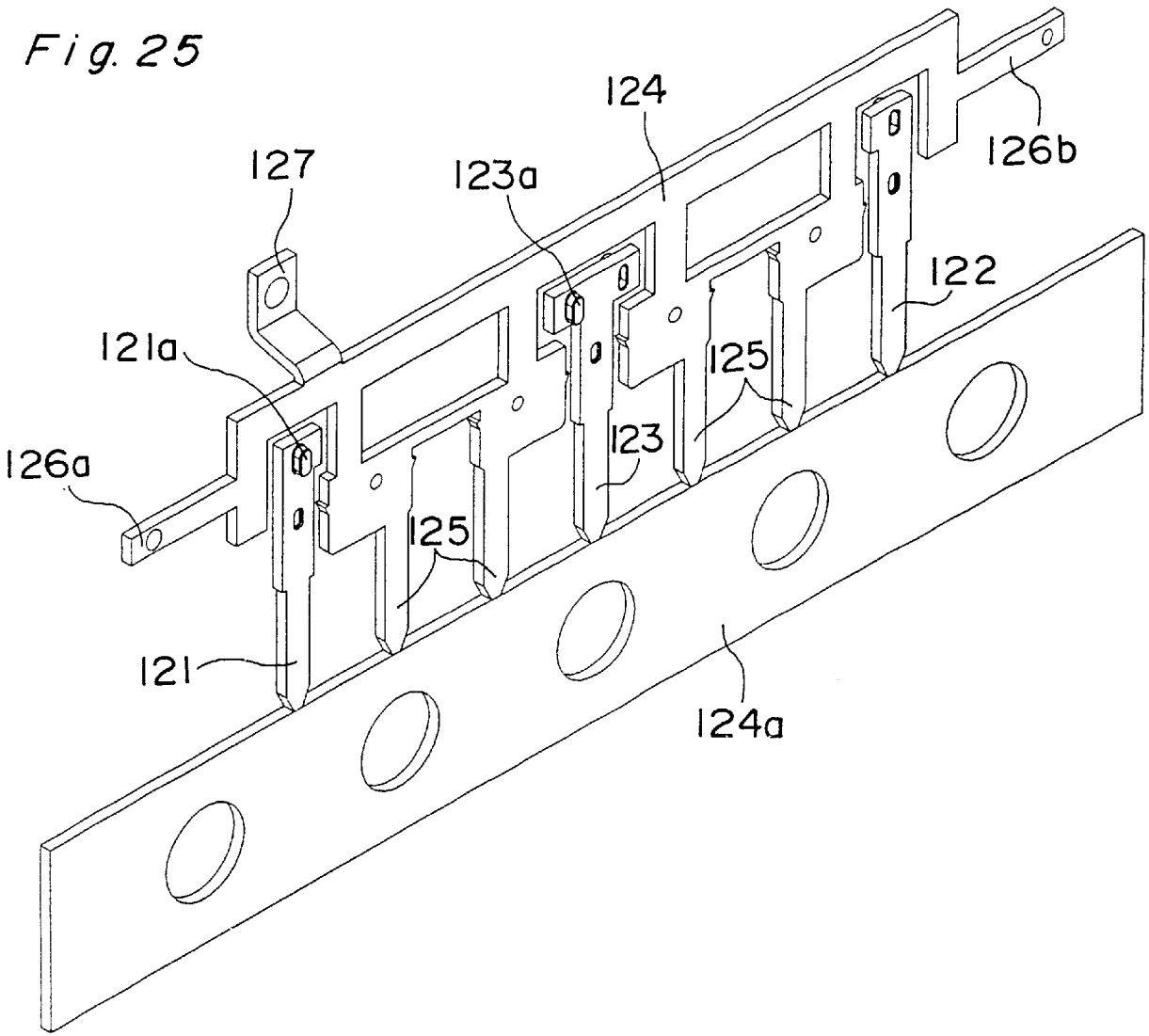
FIG. 25 is a perspective view showing a method for manufacturing a fixed contact block according to a sixth embodiment.

Therefore, by positioning the upper end portions of the fixed contact terminals 121 and 122 and the common fixed contact terminal 123 in cut portions provided on the lower side of the shield plate 124 and thereafter integrally forming these members with the retainer 120*a,* the fixed contacts 121*a* and 122*a* and the common fixed contacts 123*a* and 123*b* are exposed sideward. Further, as shown in FIG. 24, the fixed contacts 121*a* and 122*a* of the fixed contact terminals 121 and 122, the fixed contacts 123*a* and 123*b* of the common fixed contact terminal 123 and the shield plate 124 are arranged roughly in line with one another via the retainer 120*a*. With this arrangement, the so-called coplanar guide structure is obtained.

Then, the fixed contact block 120 is assembled by press-fitting its fixed contact terminals 121 and 122, the lower end portion of the common fixed contact terminal 123 and the ground terminal 125 of the shield plate 124 into the terminal holes of the base 110.

The electromagnet block 130 is formed by inserting an iron core 133 having a roughly T-figured section shape into a center hole 132*a* of a spool 132 around which a coil 131 is wound. The one end portion projecting from the center hole 132*a* is made to serve as a magnetic pole piece 133*a,* while the projecting other end portion 133*b* is fixed in a caulking manner to one end portion of a yoke 134 bent roughly in an L-figured shape. Coil terminals 135 are press-fit into flange portions 132*b* of the spool 132, and a lead wire of the coil 131 is wound around and soldered- to this.

Then, by press-fitting the coil terminals 135 into terminal holes 111*a* of the base 110, the electromagnet block 130 is positioned in the specified position.

The armature 140 is made of magnetic material and bent roughly in an L-figured shape, and its one end portion is formed into a narrowed portion 141.

The armature 140 is assembled from above along the positioning use projecting portion 114 that is projecting from the upper surface of the base. Therefore, the armature 140 is pivotally supported on the inner surface of the positioning use projecting portion 114 used as a support, and its one end portion 142 can abut against the magnetic pole piece 133*a* of the iron core 133.

The movable block 150 is made of a pair of movable bases 151 and 152 having an identical shape and a restoration spring 156.

The movable bases 151 and 152 are constructed so that movable contactors 151*b* and 152*b* are insert-molded into the lower end portions of projecting bars 151*a* and 152*a* extended downward from the side surfaces. The movable bases 151 and 152 have shaft portions 153 that project laterally from their one side end portions as well as engagement use projecting portions 154 that project laterally from their other side end portions.

The shaft portions 153 have an escape formed with flat surfaces 153*a* and 153*b* that are vertically parallel to each other. Further, a burr that cannot be avoided in the resin forming process is generated on the flat surfaces 153*a* and 153*b,* thereby allowing a smooth pivoting operation to be obtained.

The base portion of the engagement use projecting portion 154 is formed with a recess portion 155 to be engaged therewith. Further, the projecting portion 154 is formed with a projection 154*a* to be press-fit into the through hole 155*a* formed in a recess portion 155 for the engagement.

Then, the projecting portion 154 of the movable base 151 is positioned while being fit in the recess portion 155 of the movable base 152. Then, the projection 154*a* and the through hole 155*a* of the movable base 151 are press-fit on the through hole 155*a* and the projection 154*a* of the movable base 152, temporarily fixed and thereafter connected and integrated with each other by adhesive, high-frequency welding or other means.

Further, by mounting a gripping portion 157 of the restoration spring 156 on the upper edge portions of the movable bases 151 and 152 that have been connected and integrated with each other, the movable block 150 is completed.

According to the present embodiment, the movable bases 151 and 152 having the identical shape are used, and accordingly, there is the advantage that the resin molding is simplified and the manufacturing of the metal mold can be facilitated.

Then, the shaft portions 153 and 153 of the movable block 150 are fit into the bearing grooves 112*a* and 113*a* of the base 110, thereby pivotally supporting the movable block 150 in the direction of thickness. With this arrangement, the movable contactor 151*b* faces the fixed contacts 121*a* and 123*a* or the ground tongue 126*a* while being able to come into and out of contact alternately with them. On the other hand, the movable contactor 152*b* faces the fixed contacts 122*a* and 123*b* or the ground tongue 126b while being able to come into and out of contact alternately with them. Then, the tip portion of the restoration spring 156 is engaged with the engagement pawl 127 of the shield plate 124, thereby urging the movable block 150 toward the electromagnet block 130 side.

Figure 22:
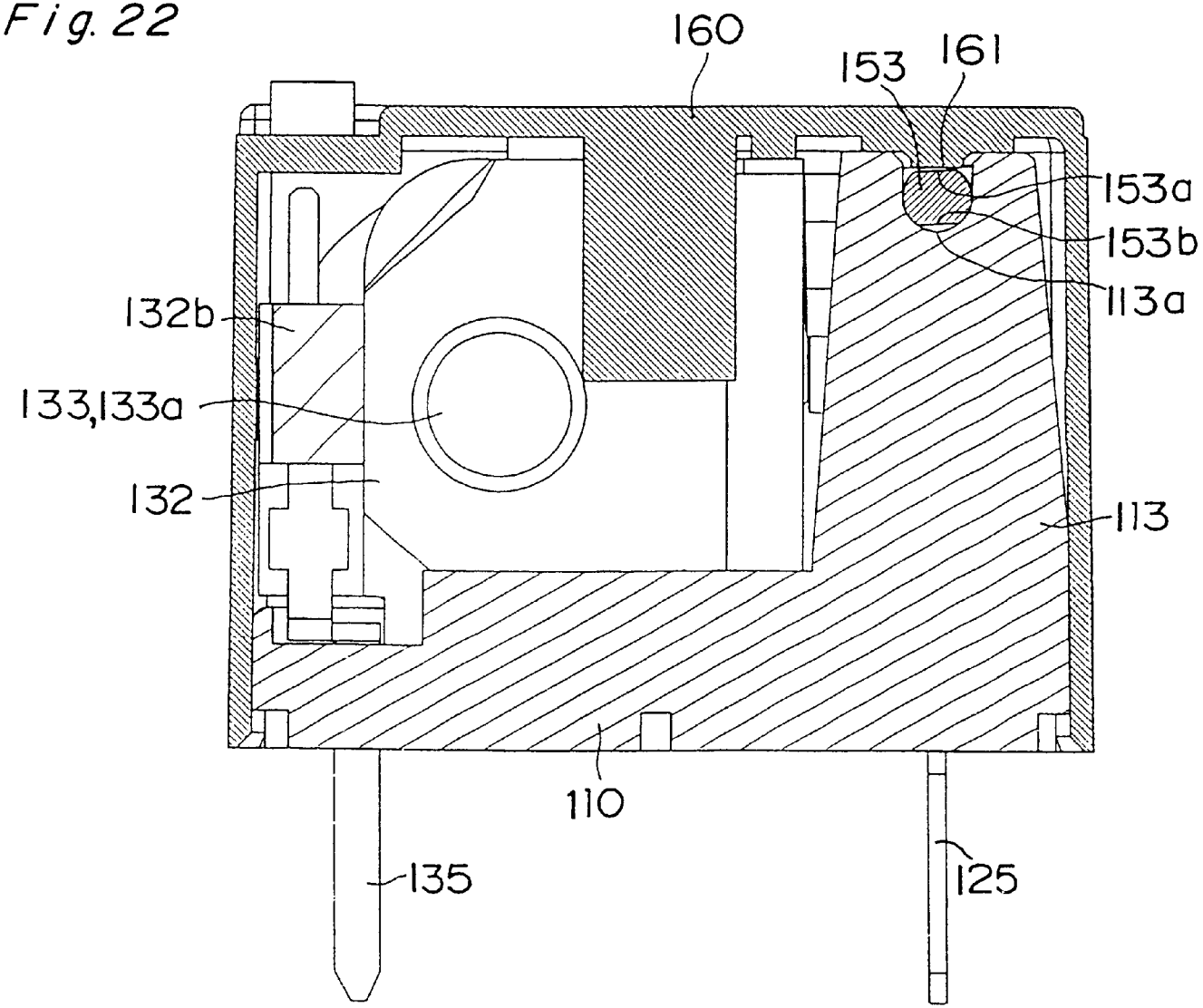
FIG. 22 is a longitudinal sectional view of the high-frequency use switch shown in FIG. 21.
Figure 23:
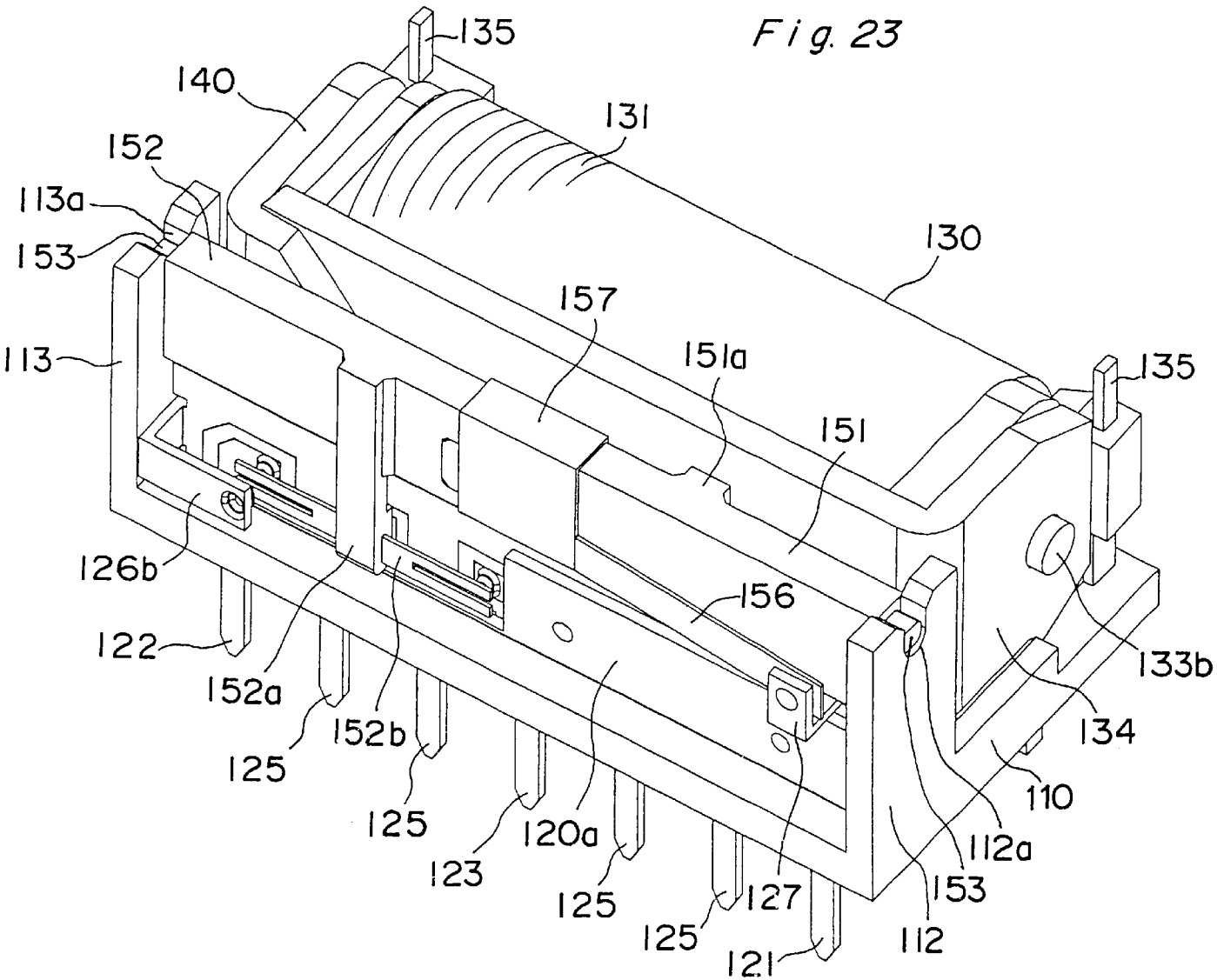
FIG. 23 is a perspective view of the high-frequency use switch shown in FIG. 21.

The casing 160 has a box-like shape that can fit on the base 110, and portions that belong to its ceiling surface and are located just above the shaft portions 153 of the movable block 150 are provided with a positioning use projecting portion 161 for preventing a lift (see FIG. 22).

When the casing 160 is fit on the base 110 integrated with the internal components, the positioning use projecting portion 161 faces the flat surface 153*a* of the shaft portion 153 with a minute gap retained between them. Then, by sealing the contact surface of the base 110 and the casing 160 with a sealant, the assembling work is completed.

The operation of the high-frequency use switch having the aforementioned construction will be described next.

When no voltage is applied to the coil 131 of the electromagnet block 130, the movable block 150 is urged toward the electromagnet block 130 side by a spring force of the restoration spring 156. Then, the movable contactor 151*b* is put in contact with the ground tongue 126*a*, while the movable contactor 152*b* is put in contact with the fixed contacts 123*b* and 122*a*.

When a voltage is applied to the coil 131 for the excitation, the one end portion 142 of the armature 141 is attracted to the magnetic pole piece 133*a* of the iron core 133. By this operation, the armature 140 pivots to make its narrowed portion 141 press the movable block 150 outward against the spring force of the restoration spring 156. Consequently, the movable block 150 pivots around the shaft portions 153, and the movable contactor 151*b* separates from the ground tongue 126*a* and comes into contact with the fixed contacts 121*a* and 123*a*. On the other hand, the movable contactor 152*b* separates from the fixed contacts 123*b* and 122*a* and comes into contact with the ground tongue 126*b*. Thereafter, the one end portion 142 of the armature 140 is attracted to the magnetic pole piece 133*a* of the iron core 133.

Subsequently, if the application of the voltage to the coil 131 is stopped, then the movable block 150 pivots in the direction opposite to the pivotal direction by the spring force of the restoration spring 156. By this operation, the movable contactor 151*b* comes into contact with the ground tongue 126*a*, and the movable contactor 152*b* comes into contact with the fixed contacts 123*b* and 122*a,* achieving restoration into the original state.

Figure 26:
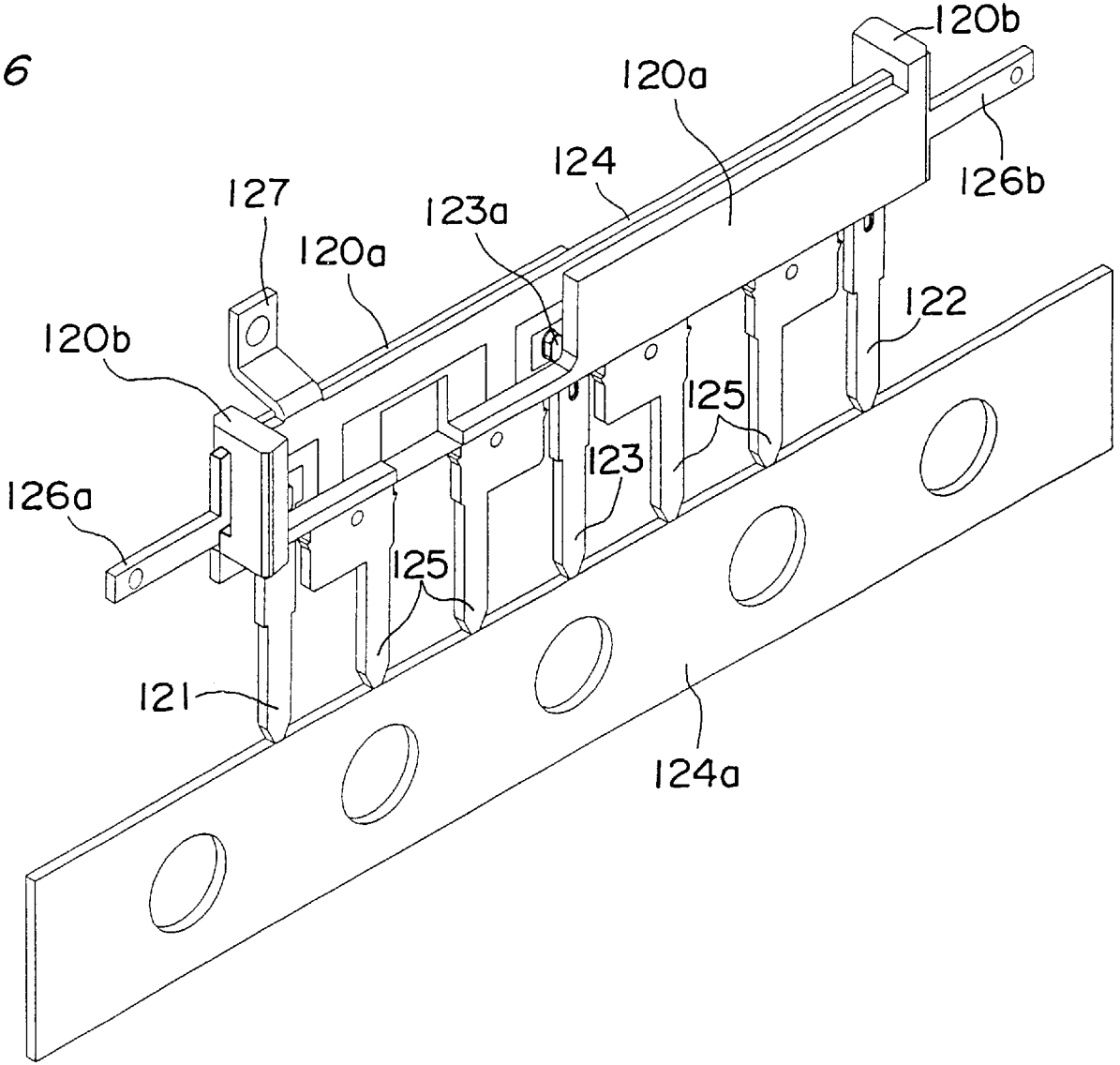
FIG. 26 is a perspective view showing a method for manufacturing a fixed contact block according to the sixth embodiment.
Figure 27:
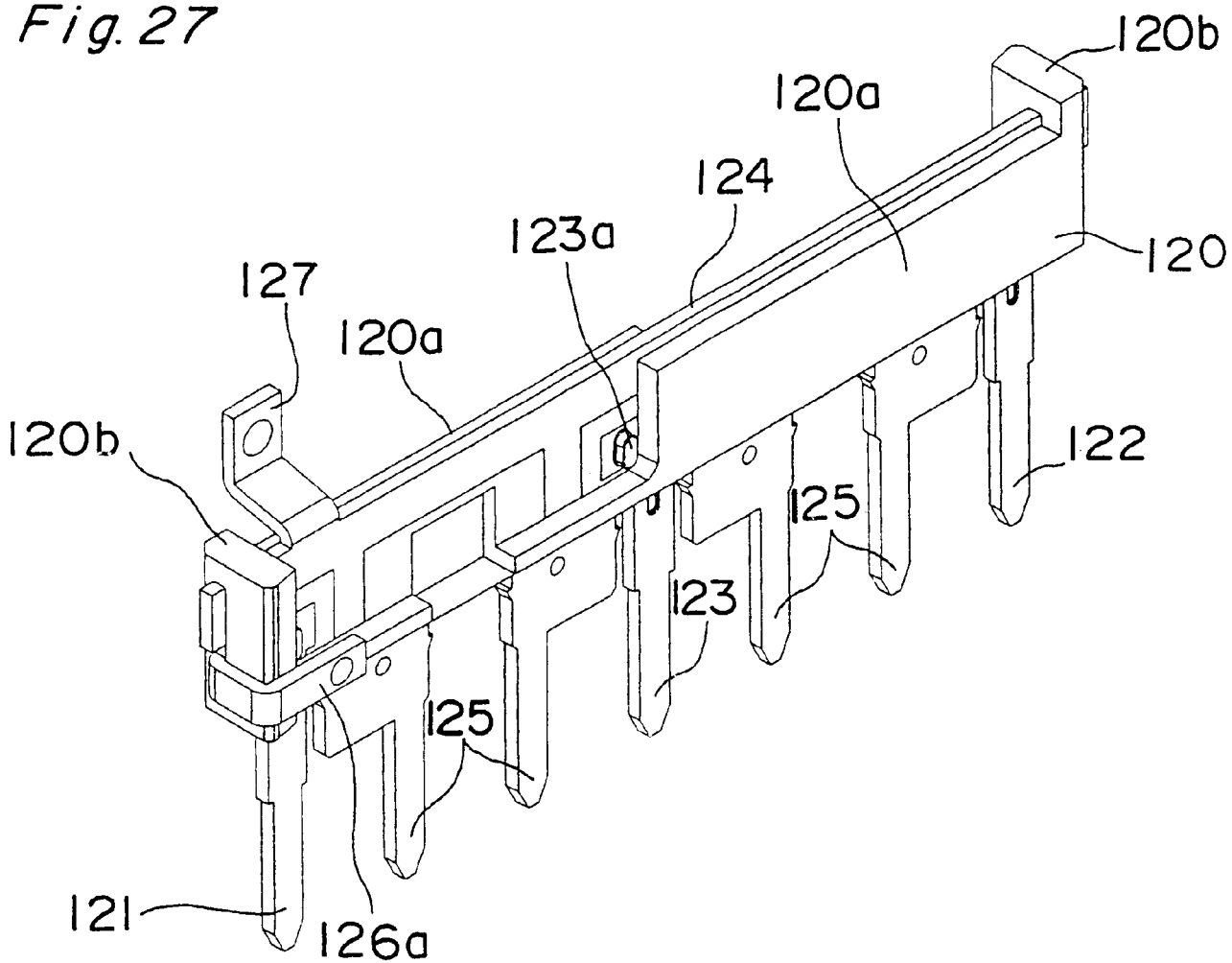
FIG. 27 is a perspective view of the fixed contact block of the sixth embodiment.
Figure 28A:
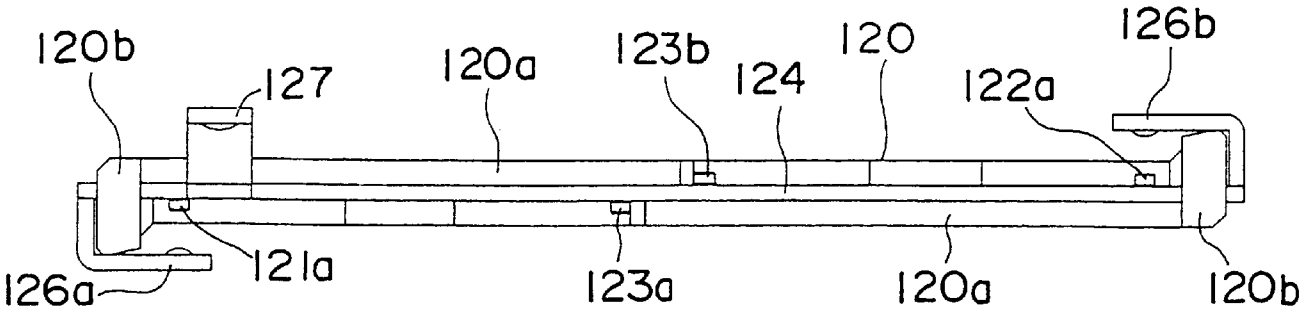
FIG. 28A is a plan view of the fixed contact block shown in FIG. 27.
Figure 28B:
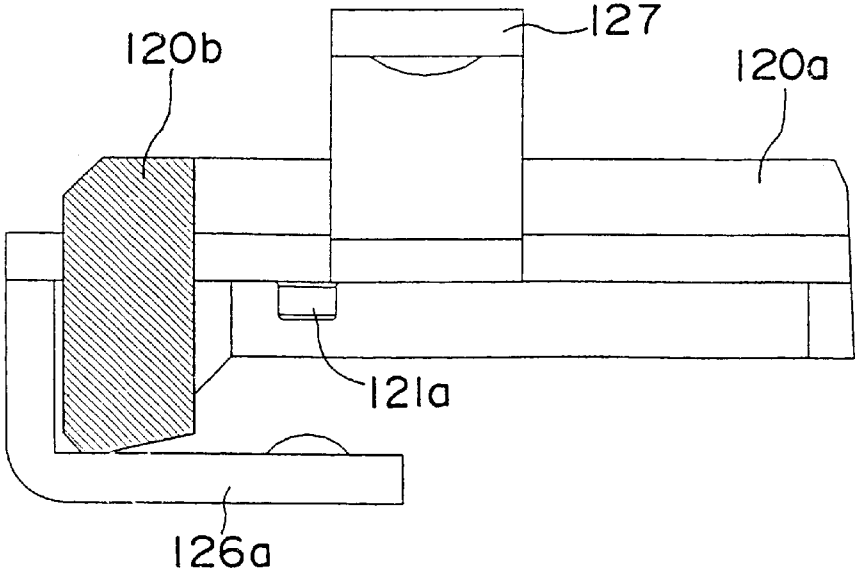
FIG. 28B is an enlarged view of part thereof.
Figure 29:
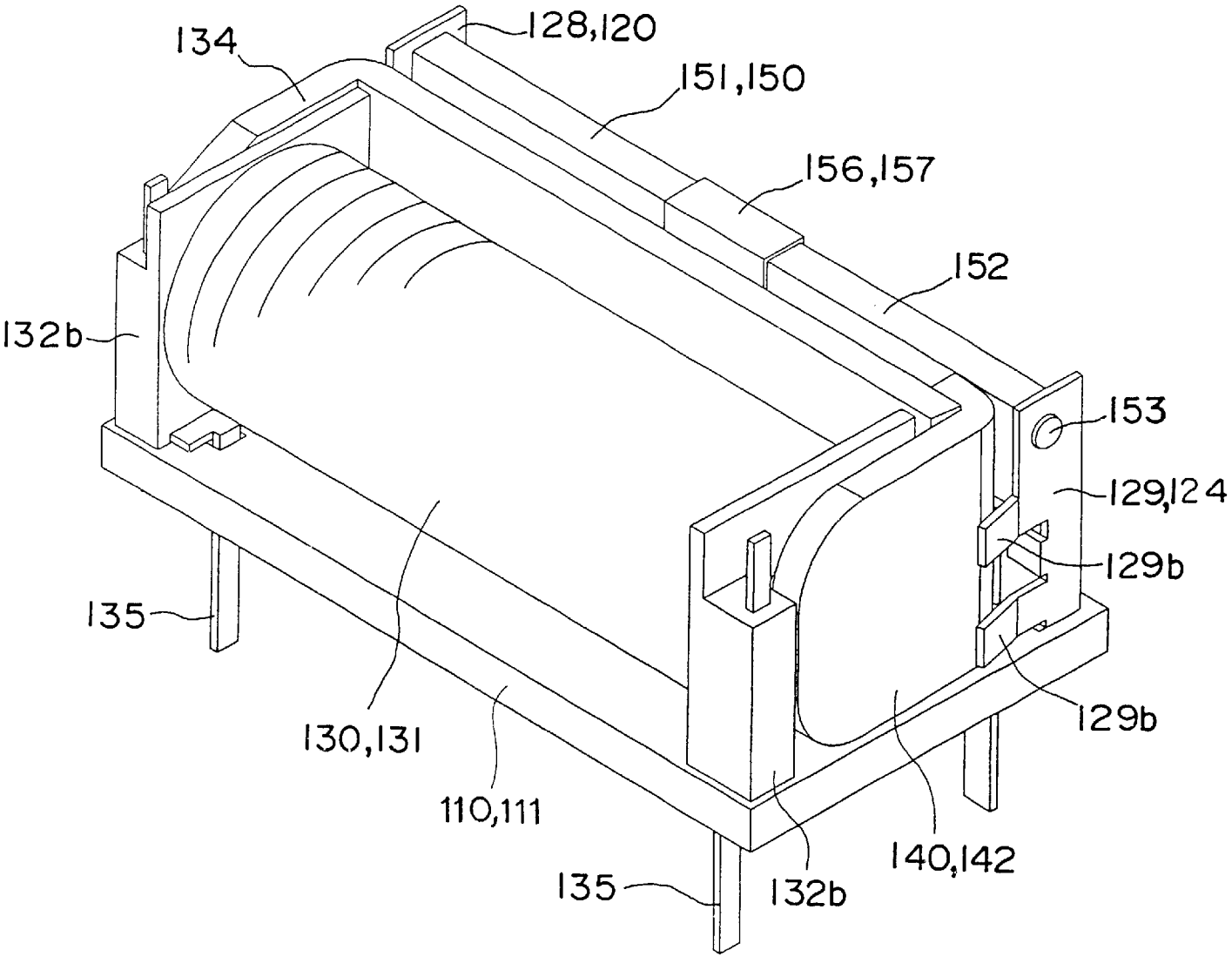
FIG. 29 is a perspective view of a high-frequency use switch according to a seventh embodiment.

A sixth embodiment is as shown in FIG. 25 through FIG. 28B, in which the retainer 120*a* is integrally formed with the fixed contact terminals 121 and 122 integrally cut out of a lead frame 124*a*, the common fixed contact terminal 123 and the shield plate 124 (see FIG. 26). A shoulder portion 120*b* that serves as a reference in bending the ground tongues 126*a* and 126*b* extends from one end portion of this retainer 120*a*.

According to the present embodiment, the shoulder portion 120*b* serves as a reference in bending the ground tongues 126*a* and 126*b*. This arrangement has the advantage that the bending work of the ground-tongues 126*a* and 126*b* can be performed correctly and speedily.

Therefore, according to the present embodiment, the fixed contact terminals 121 and 122, the common fixed contact terminal 123 and the shield plate 124 are cut out of the lead frame 124*a*, and thereafter the retainer 120*a* is integrally formed. Then, by separating the fixed contact terminals 121 and 122 and the shield plate 124 from the lead frame 124*a* and thereafter bending the ground tongues 126*a* and 126*b,* the fixed contact block 120 is completed. The other part is similar to that of the aforementioned first embodiment, and therefore, no description is provided therefor.

In contrast to the aforementioned fifth and sixth embodiments in which the movable block 150 is pivotally supported by the support walls 112 and 113 that are integrally formed with the base 110, a seventh embodiment is as shown in FIG. 29 through FIG. 33, in which support flaps 128 and 129 extend from both end portions of the shield plate 124 that is arranged upright while being press-fit into the base 10 and the shaft portions 153 and 153 of the aforementioned movable block 150 are pivotally supported while being inserted in bearing holes 128*a* and 129*a* provided for the support flaps 128 and 129.

Figure 30:
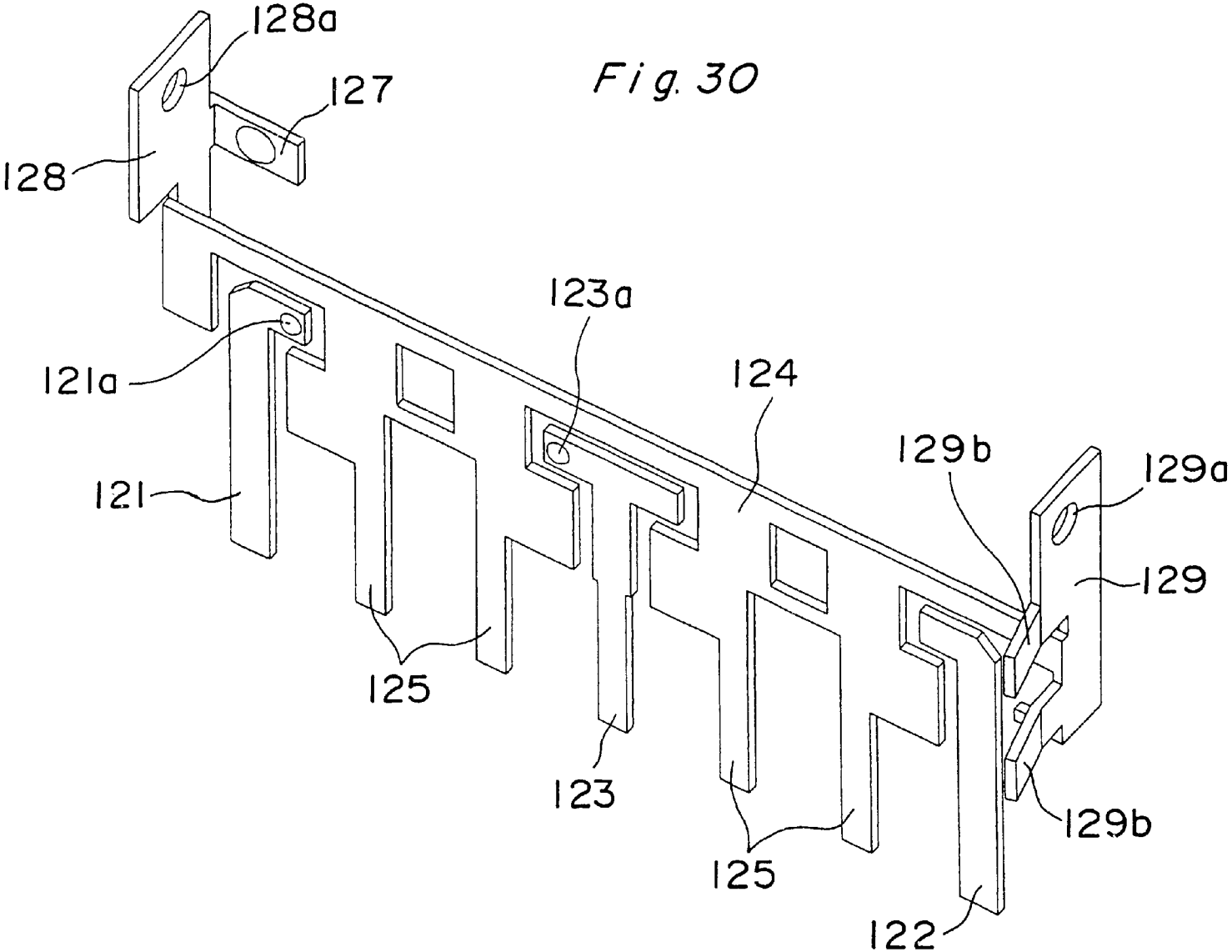
FIG. 30 is a perspective view of the fixed contact block shown in FIG. 29.
Figure 31:
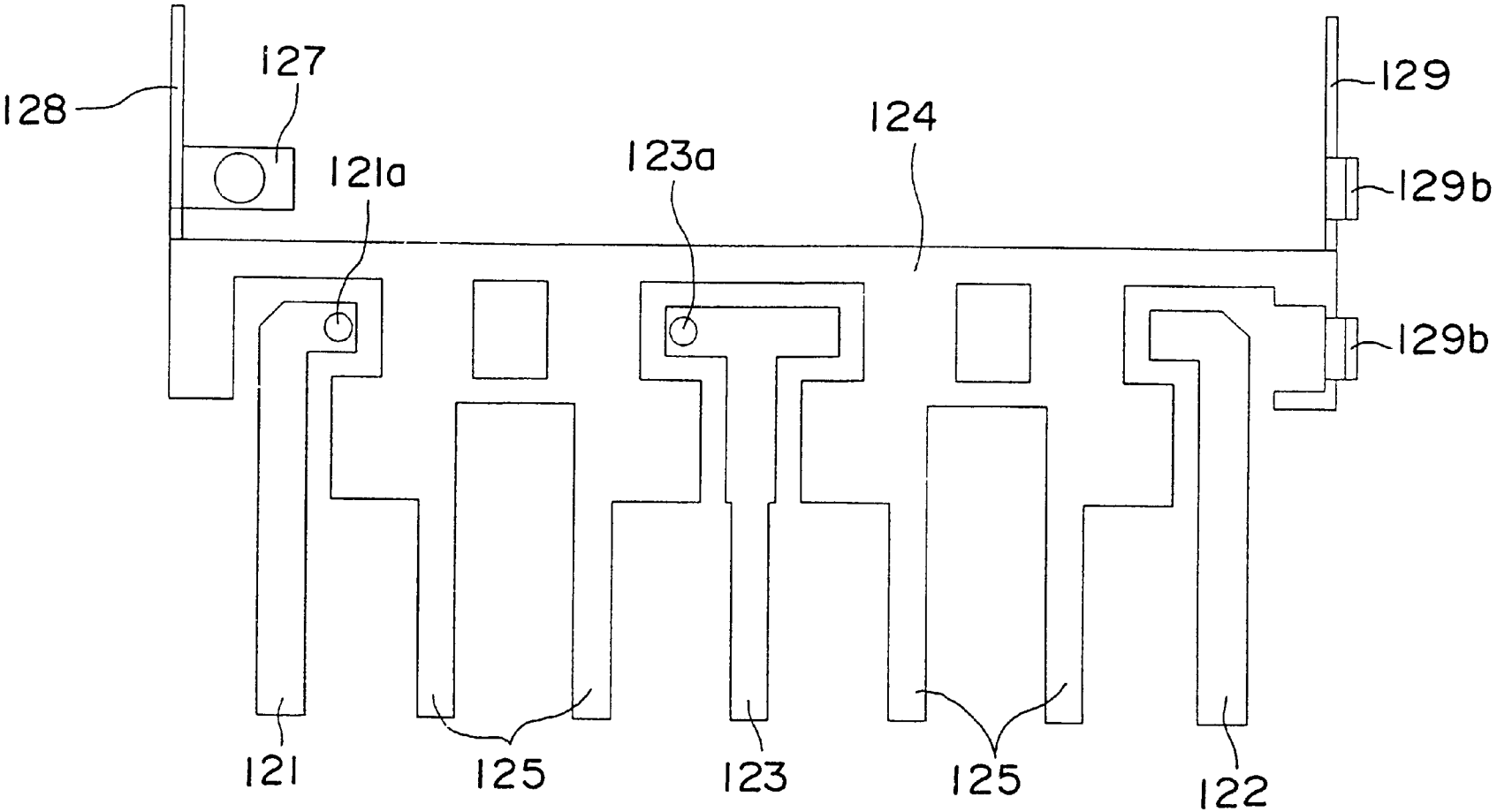
FIG. 31 is a front view of FIG. 30.
Figure 32:
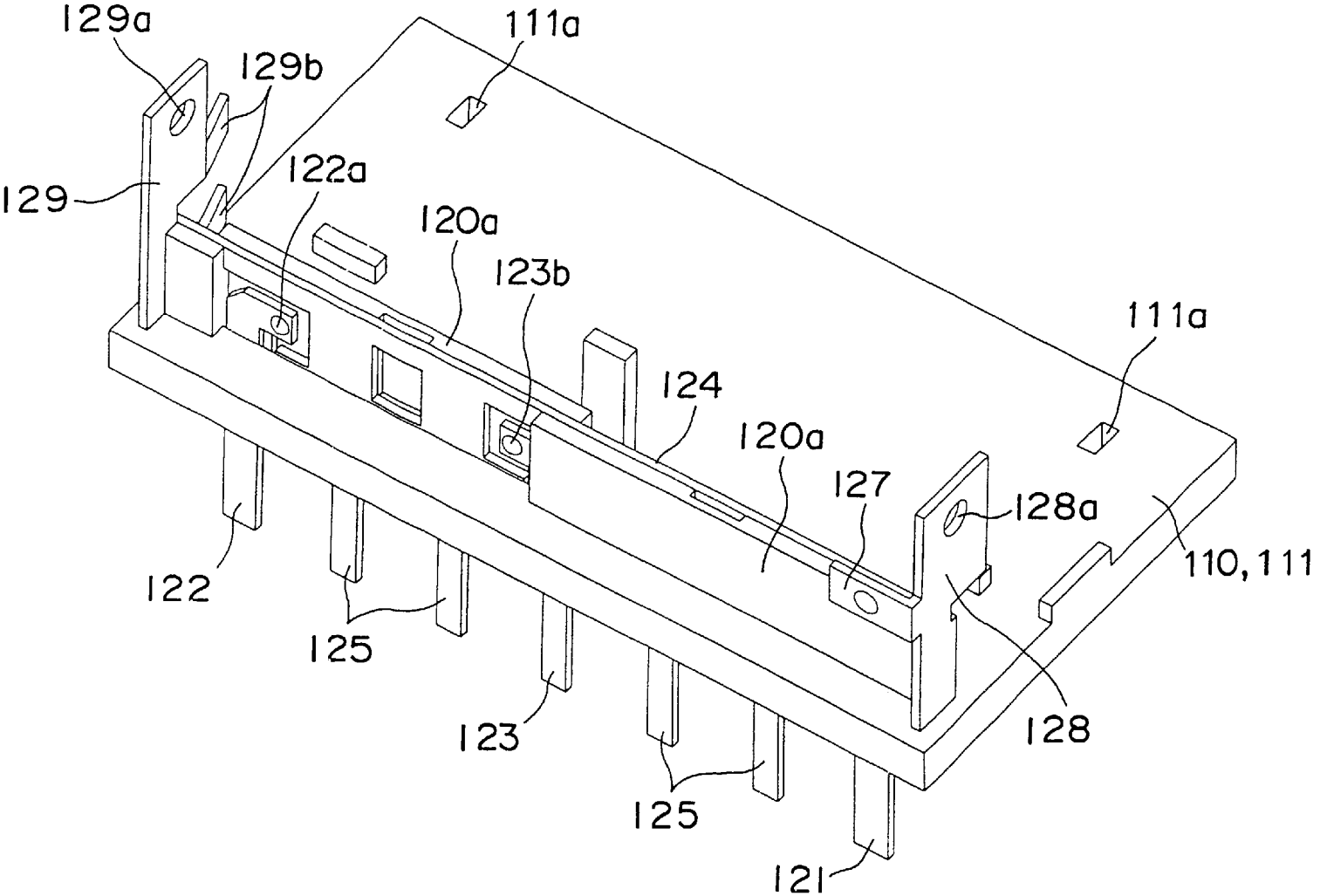
FIG. 32 is a perspective view of the base assembled with the fixed contact block shown in FIG. 30.
Figure 33:
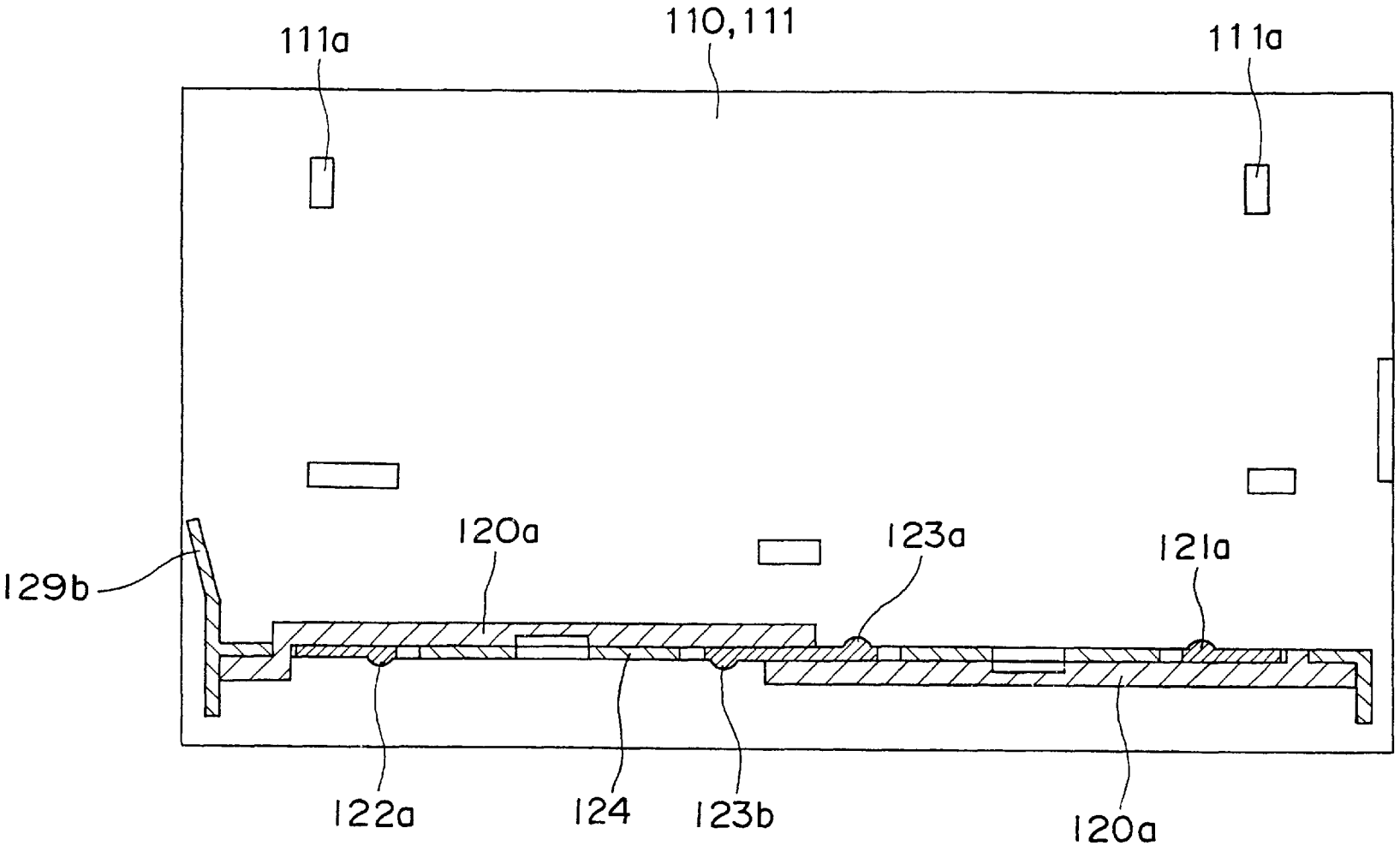
FIG. 33 is a plan view of FIG. 32.

As shown in FIG. 30, similar to the aforementioned fifth and sixth embodiments, the fixed contacts 121*a* and 122*a* and the fixed contacts 123*a* and 123*b* are arranged roughly in line with the shield plate 124, constituting a coplanar guide structure in the present embodiment.

It is to be noted that the shield plate 124 has an engagement pawl 127 which is laterally extended from its support flap 128 and with which the free end portion of the restoration spring 156 is engaged. Further, the shield plate 124 has positioning tongues 129*b* which are laterally extended from the other support flap 29 and are brought in pressure contact with the bent corner portion of the armature 140 so as to pivotally support the armature.

Therefore, similar to the aforementioned sixth embodiment, the retainer 120*a* is integrally formed with the fixed contact terminals 121 and 122, the common fixed contact terminal 123 and the shield plate 124 cut out of a lead frame (not shown). Subsequently, by separating the fixed contact terminals 121 and 122 and so on from the lead frame, the fixed contact block 120 is obtained. Further, the fixed contact terminals 121 and 122 of this fixed contact block 120, the lower end portion of the common fixed contact terminal 123 and the ground terminals 125 of the shield plate 124 are press-fit into the base 110 to be assembled therewith. The other part is almost similar to that of the aforementioned first embodiment, and therefore, no description is provided therefor.

SECOND EXPERIMENTAL EXAMPLE

The high-frequency use switch having the shield structure described in connection with the fifth embodiment was measured with regard to its high-frequency characteristic in the case where the contact circuit corresponding to the movable contactor 51*b* was opened and in the case where the contact circuit was closed. The measurement results are shown in FIG. 34 and FIG. 35.

PRIOR ART EXAMPLE

The high-frequency use switch described in connection with the prior art was measured similar to the second experimental example with regard to its high-frequency characteristic in the case where the contact circuit corresponding to the movable contactor was opened and in the case where the contact circuit was closed. The measurement results are shown in FIG. 34 and FIG. 35.

Figure 34:
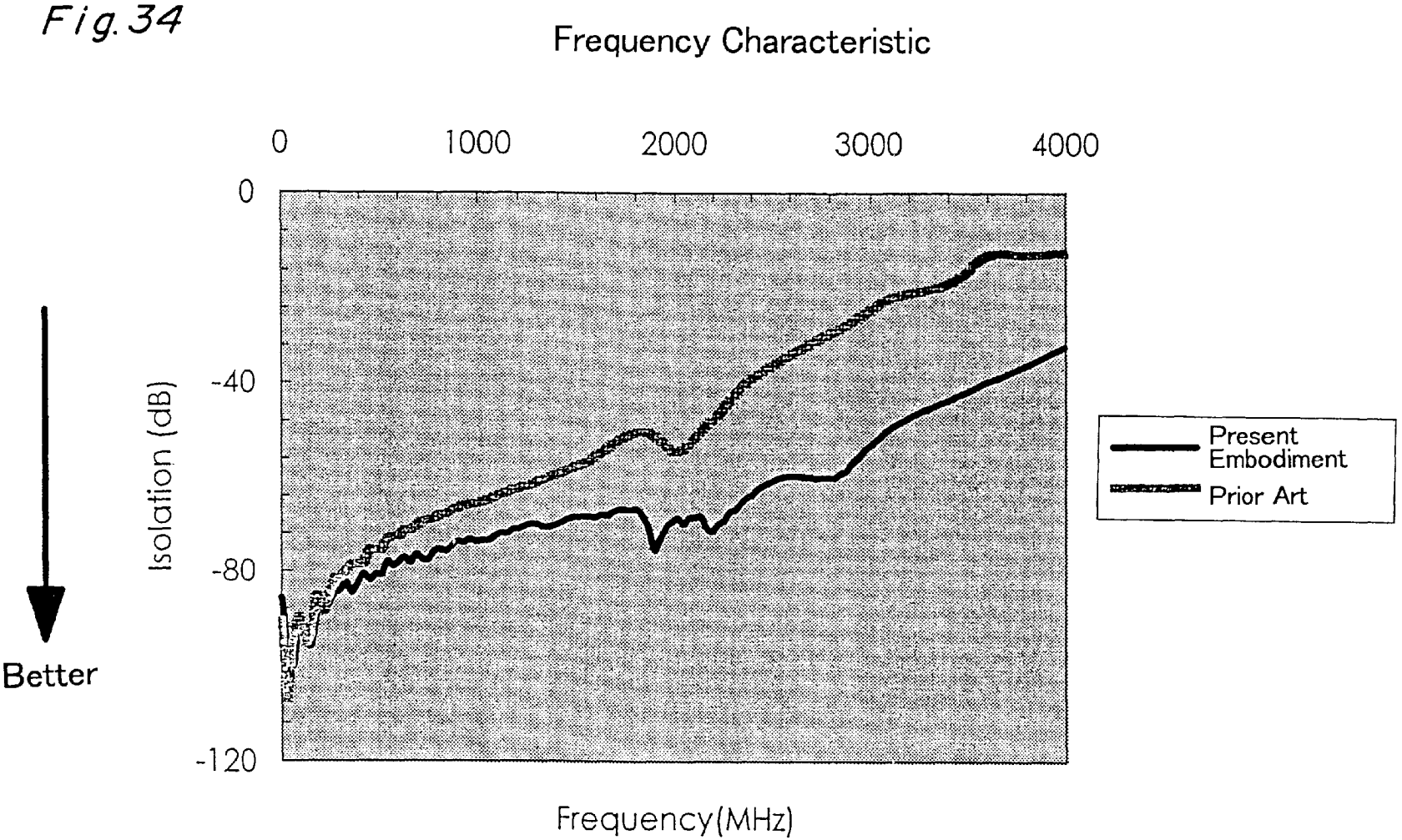
FIG. 34 is a graph showing measurement results of high-frequency characteristic in the case where the contact is opened.
Figure 35:
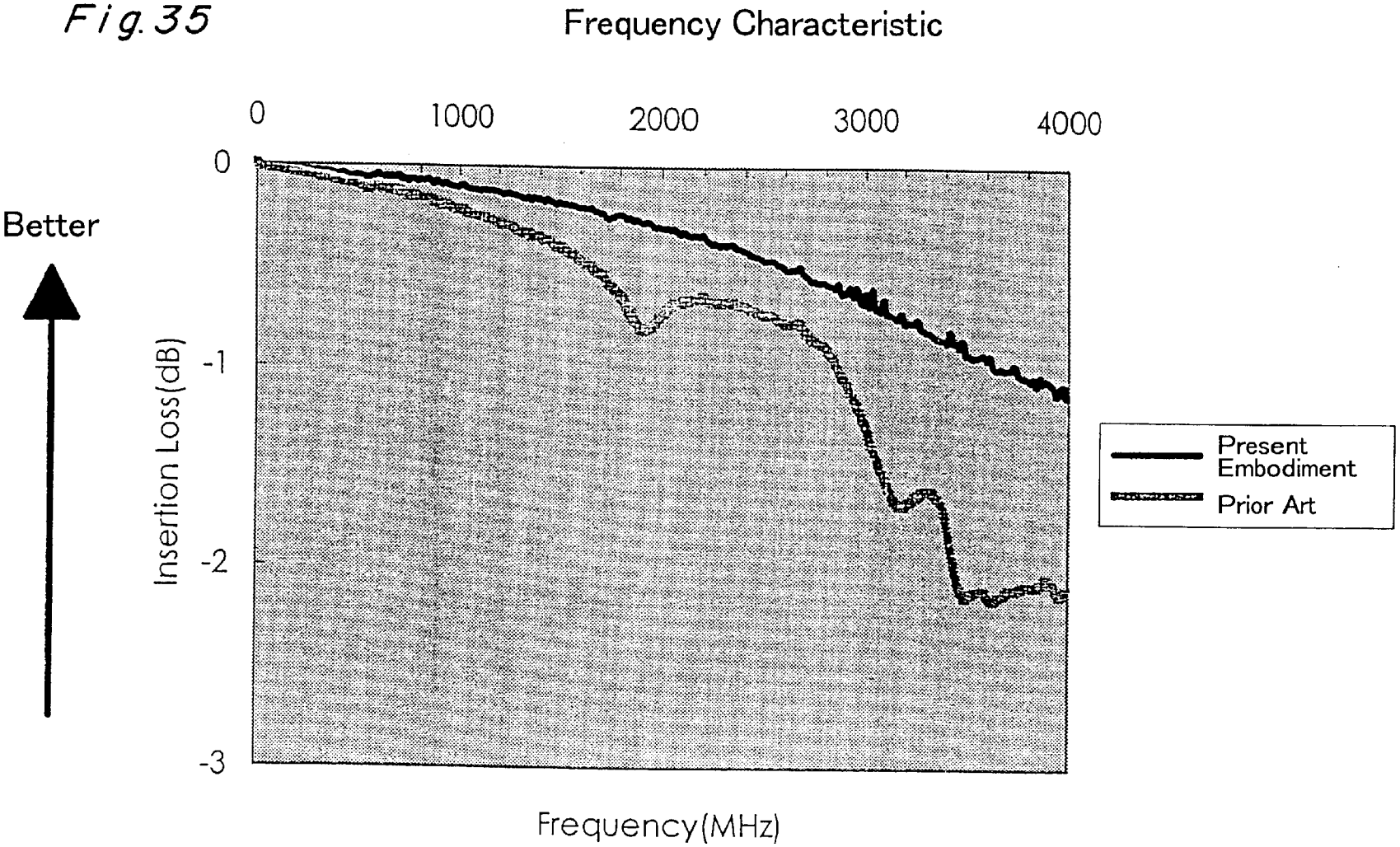
FIG. 35 is a graph showing measurement results of high-frequency characteristic in the case where the contact is closed.

As is apparent from FIG. 34, it can be found that the present second experimental example is always superior with regard to the high-frequency characteristic in the case where the contact is opened. The difference is remarkable particularly above 2000 MHz.

As is also apparent from FIG. 35, it can be found that the present second experimental example is always superior with regard to the high-frequency characteristic in the case where the contact is closed. The difference is remarkable particularly above 2000 MHz.

This can be considered to be ascribed to the fact that impedance matching can be attained almost throughout the entire range in the second experimental example as compared with the fact that impedance matching can be attained only partially in the prior art.

The retainer 120*a* of the fixed contact block 120 is not always required-to be separated from the base 110 and is, of course, allowed to be integrally formed with the base 110.

INDUSTRIAL APPLICABILITY

The present invention can be applied not only to the high-frequency use switches of the aforementioned embodiments but also to the high-frequency use switches of other high-frequency use switches.

What is claimed is:

1. A high-frequency switch, wherein a pair of movable contacts that reciprocate in a direction of thickness thereof on a basis of excitation and nonexcitation of an electromagnetic block have end portions, both of the end portions of each movable contact are brought in and out of contact alternately with a normally-open common fixed contact and a normally-open fixed contact and with a normally-closed common fixed contact and a normally-closed fixed contact to open and close different high-frequency current circuits; and wherein the pair of movable contacts are arranged in parallel so as not to face each other, the normally-open common fixed contact and the normally-closed common fixed contact extend in opposite directions, and dielectrics, made of insulating walls molded integral with a base, are respectively arranged between the normally-open common fixed contact and the normally-open fixed contact, and a normally-open shield member, and between the normally-closed common fixed contact and the normally-closed fixed contact, and a normally-closed shield member.

2. A high frequency switch, wherein a pair of movable contacts that reciprocate in a direction of thickness thereof on a basis of excitation and nonexcitation of an electromagnet block have end portions, both of the end portions of each movable contact are brought in and out of contact alternately with a normally-open common fixed contact and a normally-open fixed contact and with a normally-closed common fixed contact and a normally-closed fixed contact to open and close different high-frequency current circuits; and wherein the pair of movable contacts are arranged in parallel so as not to face each other, the normally-open common fixed contact and the normally-closed common fixed contact extend in a same direction so as to be integral with each other, and a dielectric made of a molded insulating material is arranged between the normally-open common fixed contact, the normally-closed common fixed contact, the normally open fixed contact and the normally closed fixed contact, and a shield member.

3. A high-frequency switch, wherein a pair of movable contacts that reciprocate in a direction of thickness thereof on a basis of excitation and nonexcitation of an electromagnet block have end portions, both of the end portions of each movable contact are brought in and out of contact alternately with a normally-open common fixed contact and a normally-open fixed contact and with a normally-closed common fixed contact and a normally-closed fixed contact to open and close different high-frequency current circuits; and wherein the pair of movable contacts are arranged in line with one another in an insulated state, the normally-open common fixed contact and the normally-closed common fixed contact extend in opposite directions, and dielectrics made of a insulating walls, which are molded integral with a base, are respectively arranged between the normally-open common fixed contact and the normally-open fixed contact, and a normally-open shield member, and between the normally-closed common fixed contact and the normally-closed fixed contact, and a normally-closed shield member.

4. A high-frequency switch as claimed in claim 2, wherein the dielectric is constructed of at least a pair of insulating walls arranged parallel to each other with a distance between each pair adjacent insulating walls equal to a thickness of the shield member.

5. A high-frequency switch as claimed in claim 1, wherein a lower end portion of a fixed contact terminal provided with the fixed contact and a lower end portion of a ground terminal extended from the shield member are arranged in line with each other.

6. A high-frequency switch as claimed in claim 2, wherein a ground tongue extending on the shield member and with which the movable contact comes in contact when separated from the fixed contacts.

7. A high-frequency switch as claimed in claim 1, further comprising an engagement pawl engaging a restoration spring and extending on the shield member, the restoration spring biasing the movable contact.

8. A high-frequency switch, wherein a pair of movable contacts that reciprocate in a direction of thickness thereof on a basis of excitation and nonexcitation of an electromagnet block have end portions, both of the end portions of each movable contact are brought in and out of contact alternately with a normally-open common fixed contact and a normally-open fixed contact and with a normally-closed common fixed contact and a normally-closed fixed contact to open and close different high-frequency current circuits; and wherein the pair of movable contacts are arranged in parallel so as not to face each other, the normally-open common fixed contact and the normally-closed common fixed contact extend in opposite directions; a normally-open shield member is arranged between the normally-open common fixed contact and the normally-open fixed contact, a normally-closed shield member is arranged between the normally-closed common fixed contact and the normally-closed fixed contact, and dielectrics made of insulating walls, which are molded integral with a base or the shield member, are respectively arranged between the fixed contacts and the shield member.

9. A high-frequency switch, wherein a pair of movable contacts that reciprocate in a direction of thickness thereof on a basis of excitation and nonexcitation of an electromagnet block have end portions, both of the end portions of each movable contact are brought in and out of contact alternately with a normally-open common fixed contact and a normally-open fixed contact and with a normally-closed common fixed contact and a normally-closed fixed contact to open and close different high-frequency current circuits; and wherein the pair of movable contacts are arranged in parallel so as not to face each other, the normally-open common fixed contact and the normally-closed common fixed contact extend in opposite directions, a normally-open shield member is arranged between the normally-open common fixed contact and the normally-open fixed contact, a normally-closed shield member is arranged between the normally-closed common fixed contact and the normally-closed fixed contact, and dielectrics made of a insulating walls, which are molded integral with a base or the shield member, are respectively arranged on a side surface of the normally-open common fixed contact, the normally-closed common fixed contact, and the normally-open shield member, and on a side surface of the normally-closed common fixed contact, the normally-closed fixed contact and the normally-closed shield member.

10. A high-frequency switch as claimed in claim 8, wherein a ground tongue extending from at least one end portion of a shield member and with which the movable contact that is separated from the fixed contacts comes in contact.

11. A high-frequency switch as claimed in claim 9, wherein a bending shoulder portion is integrally formed with a base portion of a ground tongue.

* * * * *